US007611233B2

(12) United States Patent
Nagashima

(10) Patent No.: US 7,611,233 B2
(45) Date of Patent: Nov. 3, 2009

(54) LIQUID EJECTION HEAD, LIQUID EJECTION APPARATUS, AND IMAGE FORMING APPARATUS

(75) Inventor: Kanji Nagashima, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 349 days.

(21) Appl. No.: 11/239,298

(22) Filed: Sep. 30, 2005

(65) Prior Publication Data

US 2006/0082617 A1 Apr. 20, 2006

(30) Foreign Application Priority Data

Sep. 30, 2004 (JP) ..... 2004-288781

(51) Int. Cl.
*B41J 2/045* (2006.01)

(52) U.S. Cl. ..... 347/72

(58) Field of Classification Search ..... 347/68, 347/70–72

See application file for complete search history.

(56) References Cited

U.S. PATENT DOCUMENTS 6,382,754 B1 * 5/2002 Morikoshi et al. ..... 347/11
6,500,354 B1 * 12/2002 Lee et al. ..... 216/27
6,695,437 B2 * 2/2004 Nakamura et al. ..... 347/70
6,712,455 B2 * 3/2004 Dante ..... 347/68
2005/0068377 A1 * 3/2005 Ishikawa et al. ..... 347/68
2006/0071723 A1 * 4/2006 Takeuchi ..... 331/65

FOREIGN PATENT DOCUMENTS

JP 5-38809 A 2/1993

* cited by examiner

*Primary Examiner*—An H Do
(74) *Attorney, Agent, or Firm*—Birch, Stewart, Kolasch & Birch, LLP

(57) ABSTRACT

The liquid ejection head includes: a plurality of liquid ejection ports; a plurality of pressure chambers which are respectively communicated with the liquid ejection ports; a diaphragm which configures at least one surface of each of the pressure chambers; and a plurality of piezoelectric elements which are disposed on a surface of the diaphragm opposite from the pressure chamber, and from which at least individual electrodes are separated in an area corresponding to the pressure chamber, wherein liquid is ejected from the liquid ejection port by causing the plurality of piezoelectric elements to make vibration.

26 Claims, 16 Drawing Sheets

LIQUID EJECTION HEAD, LIQUID EJECTION APPARATUS, AND IMAGE FORMING APPARATUS

BACKGROUND OF THE INVENTION

1. Field of the Invention

The present invention relates to a liquid ejection head, liquid ejection apparatus, and image forming apparatus, more particularly to a structure and drive control technology of a liquid ejection head which is suitable for an image forming apparatus such as an inkjet recording apparatus for forming an image on a recording medium by ejecting minuscule liquid droplets.

2. Description of the Related Art

Japanese Patent Application Publication No. 5-38809 discloses an inkjet head which generates ultrasonic wave in ink by driving, at high frequency, a piezoelectric substrate disposed in parallel with a nozzle plate, and ejects mist-like ink (ink mist) from the nozzles. Japanese Patent Application Publication No. 5-38809 further proposes disposition of a concave acoustic lens between the piezoelectric substrate and the nozzle plate in order to focus pressure wave in the vicinity of the nozzles.

However, in the configuration disclosed Japanese Patent Application Publication No. 5-38809, an acoustic lens is required as a device (member) for concentrating ejection energy. Furthermore, not only a high-speed and high-quality print output in recent years, but also maximization of the density of nozzles in a recording head, and further improvement of ejection power are required. In addition, functions controlling the spatter direction or the amount of ejected liquid, and detecting an ejection failure are required to be maximized. In this regard, application to maximization of the function and density is not considered sufficiently in Japanese Patent Application Publication No. 5-38809.

SUMMARY OF THE INVENTION

The present invention has been contrived in view of the aforementioned circumstances, and an object thereof is to provide a structure of a liquid ejection head which is suitable for density maximization, a liquid ejection apparatus using such a structure, and an image forming apparatus.

In order to attain the aforementioned object, the present invention is directed to a liquid ejection head, comprising: a plurality of liquid ejection ports; a plurality of pressure chambers which are respectively communicated with the liquid ejection ports; a diaphragm which configures at least one surface of each of the pressure chambers; and a plurality of piezoelectric elements which are disposed on a surface of the diaphragm opposite from the pressure chamber, and from which at least individual electrodes are separated in an area corresponding to the pressure chamber, wherein liquid is ejected from the liquid ejection port by causing the plurality of piezoelectric elements to make vibration.

According to the present invention, a plurality of piezoelectric elements are provided in each of the pressure chambers, and the liquid is ejected from the liquid ejection port of the pressure chamber by causing these piezoelectric elements to vibrate. Since the individual electrodes of each piezoelectric element are separated, each element can be driven individually. Pressure wave can be focused in the vicinity of the liquid ejection port by controlling the drive phases, drive timings, drive waveforms and the like of the plurality of piezoelectric elements, and improvement of the ejection efficiency can be achieved. The size of the pressure chamber can be minimized by improving the ejection efficiency, whereby density maximization can be achieved.

Moreover, by controlling the number of piezoelectric elements to be driven simultaneously, and also by controlling the drive phases, drive timings, drive waveforms and the like, the amount of liquid droplets at the time of ejection, and the spatter direction (ejection direction) of the liquid droplets can be controlled, or acoustic crosstalk can be prevented. Further, a piezoelectric element which is not driven can be utilized as a pressure determination sensor, whereby maximization of the function can be realized in various ways as compared to the prior art.

Preferably, the vibration is ultrasonic vibration.

According to the present invention, mist-like minuscule liquid droplets can be ejected from the liquid ejection port of the pressure chamber by causing the piezoelectric elements to vibrate ultrasonically.

Preferably, a thickness of a piezoelectric substance of the piezoelectric element is one-fourth or one-half of a sonic wavelength in the piezoelectric substance of a drive frequency of the ultrasonic vibration.

As a configuration for causing ultrasonic vibration, an embodiment is preferred in which the thickness of the piezoelectric substance is made to be one-fourth or one-half of the sonic wavelength in the piezoelectric substance of the drive frequency, and, according to this configuration, high frequency drive is possible by the frequency of the ultrasonic wave.

Preferably, the plurality of piezoelectric elements are arranged concentrically in the area of the diaphragm corresponding to the pressure chamber.

In this case, in addition to the embodiment in which the piezoelectric elements broken up into a ring shape of a concentric circle are disposed concentrically, an embodiment is possible in which the piezoelectric elements, which are obtained by further breaking the ring-shaped elements up into two or more part in a circumferential direction, are disposed concentrically. According to this configuration, the pressure wave can be concentrated easily into the vicinity of the central axis of the concentric circle.

Preferably, the plurality of piezoelectric elements are arranged in a matrix along a first direction and a second direction perpendicular to the first direction in the area of the diaphragm corresponding to the pressure chamber.

A variety of aspects of the driving can be realized by arranging the plurality of piezoelectric elements in a matrix according to the shape of the pressure chamber, and controlling the drive of each of the piezoelectric elements individually.

Preferably, a form of array of the plurality of piezoelectric elements in the area of the diaphragm corresponding to the pressure chamber has rotational symmetries through $\alpha$ degrees ($0° < \alpha < 180°$).

The plurality of piezoelectric elements are preferably arranged to have a generally homogeneous distribution (in a state with no significant directionality/anisotropy) in a pressure chamber-corresponding region of a diaphragm. For example, the piezoelectric elements are arranged to have rotational symmetries through $\alpha$ degrees ($0° < \alpha < 180°$). In this case, the axis of rotational symmetry is preferably configured so as to pass through the center (or the center of gravity) having a shape of the range of the diaphragm corresponding to the pressure chamber.

Preferably, when viewed from a direction perpendicular to an ejection face on which the plurality of liquid ejection ports are formed, a center of a group of the piezoelectric elements formed by arraying the plurality of piezoelectric elements substantially matches with a center of the liquid ejection port corresponding to the pressure chamber for which the group of piezoelectric elements is disposed.

According to such a configuration, the pressure wave can be concentrated easily into the vicinity of the liquid ejection port, and the ejection efficiency can be improved.

Preferably, when viewed from a direction perpendicular to an ejection face on which the plurality of liquid ejection ports are formed, a center of a group of the piezoelectric elements formed by arraying the plurality of piezoelectric elements is displaced in a direction of relative movement of the liquid ejection head and an ejection receiving medium, with respect to a center of the liquid ejection port corresponding to the pressure chamber for which the group of piezoelectric elements is disposed.

According to such a configuration, the distribution of the piezoelectric elements arranged in the range of the diaphragm corresponding to the pressure chamber is nonsymmetric in relation to the liquid ejection port. Thus a pressure difference can be generated easily in the direction of relative movement of the medium subjected to ink ejection with respect to the liquid ejection head, and droplets can be ejected from the liquid ejection port in an oblique direction. In particular, an embodiment is preferred in which the center of the liquid ejection port is configured upstream, and the centers of the piezoelectric elements downstream along the direction of relative movement of the medium subjected to ink ejection with respect to the liquid ejection head so that liquid droplets are ejected toward the direction (upstream direction) opposite to the direction of relative movement of the medium subjected to ink ejection with respect to the liquid ejection head.

Preferably, in the area of the diaphragm corresponding to the pressure chamber, a piezoelectric element having a larger area is arranged in an area on a downstream side in a relative movement direction of an ejection receiving medium with respect to the liquid ejection head.

Preferably, in the area of the diaphragm corresponding to the pressure chamber, a larger number of piezoelectric elements are arranged in an area on a downstream side in a relative movement direction of an ejection receiving medium with respect to the liquid ejection head.

According to these configurations, the distribution of the piezoelectric elements in the range of the diaphragm corresponding to the pressure chamber is nonsymmetric in relation to the liquid ejection port. Thus a pressure difference can be generated easily in the direction of relative movement of the medium subjected to ink ejection with respect to the liquid ejection head, and droplets can be ejected from the liquid ejection port in an oblique direction.

Preferably, the diaphragm has a convex surface on a side opposite to the pressure chamber.

More preferably, the diaphragm is configured so as to be formed into a substantially cubic form or a substantially a cylindrical form, and the center of curvature thereof is made correspond to the center of the liquid ejection port. According to such an embodiment, the pressure wave generated in each of the piezoelectric elements can be concentrated into the vicinity of the liquid ejection port, and a large displacement can be obtained.

In order to attain the aforementioned object, the present invention is also directed to a liquid ejection apparatus, comprising: the above-described liquid ejection head; a drive signal generating device which generates drive signals for driving the plurality of piezoelectric elements; a drive control device which controls the drive signals applied to the piezoelectric elements; and a conveying device which conveys at least one of the liquid ejection head and an ejection receiving medium so as to relatively move the ejection receiving medium with respect to the liquid ejection head.

The ejection efficiency can be improved, and maximization of the function can be realized by controlling the combination of the plurality of piezoelectric elements when operating them, the number of piezoelectric elements to be driven simultaneously, drive timings, drive phases, drive waveforms and the like.

Preferably, the drive control device controls variably at least one of a frequency of the drive signal and an application timing of the drive signal with respect to each of the piezoelectric elements.

Preferably, liquid droplets are ejected from the liquid ejection ports towards an upstream side of a direction of relative movement of the ejection receiving medium with respect to the liquid ejection head.

Control of the ejection direction can be possible by means of the configuration in which the position of the center of the liquid ejection port is displaced in relation to the position of the centers of the piezoelectric elements, or by controlling the drive of the plurality of piezoelectric elements, or alternatively by means of a combination of the above.

Preferably, the drive signal generating device generates a first drive signal for ultrasonically vibrate the piezoelectric elements, and a second drive signal having a lower frequency than that of the first drive signal; and the drive control device controls selective application of the first drive signal and the second drive signal to the piezoelectric elements.

By applying the first drive signal to some of the plurality of piezoelectric elements, and by applying the second drive signal to the rest of the piezoelectric elements, the ejection speed can be raised through the synthetic drive by ultrasonic vibration and vibration at a frequency lower than that of the ultrasonic wave.

Furthermore, the amount of droplets to be ejected can be controlled by an embodiment in which the first drive signal is used when ejecting small droplets, and the second drive signal is used when ejecting large droplets.

Preferably, at least one of the plurality of piezoelectric elements is also used as a determining element for determining pressure during drive of another of the piezoelectric elements, and the liquid ejection apparatus further comprises: a determination signal processing device which performs processing on a determination signal obtained from the piezoelectric element that is used as the determining element; and a judging device which judges a state of ejection according to a result of processing carried out by the determination signal processing device.

An ejection failure (non-ejection and the like) can be detected by utilizing a mechano-electrical transducer function of the piezoelectric elements, and using the non-driven piezoelectric elements also as pressure determining elements. Moreover, since it is not necessary to provide a special determining element, the ejection head is suitable for density maximization.

Preferably, of the plurality of piezoelectric elements, a piezoelectric element disposed in a vicinity of a liquid supply port of the pressure chamber is applied with a drive signal which causes the piezoelectric element to generate a pressure wave having a phase for relatively weakening a pressure wave generated by another of the piezoelectric elements.

According to such a configuration, the pressure wave generated by other piezoelectric elements is prevented from being transmitted to the upstream side of a supply flow passage through a liquid supply port, whereby is it possible to reduce the acoustic crosstalk sent to the other pressure chambers (other liquid ejection ports) communicated with each other via the flow passage on the supplying side.

In order to attain the aforementioned object, the present invention is also directed to an image forming apparatus, comprising the above-described liquid ejection apparatus and forming an image on the ejection receiving medium by means of the liquid ejected from the liquid ejection head.

Specifically, the liquid ejection apparatus can be suitably used in an image forming apparatus as typified by an inkjet recording apparatus. In this case, an embodiment of the liquid ejection head can be a full-line recording head having nozzle rows in which a plurality of liquid ejection ports (nozzles) for ejecting ink are arranged along a length corresponding to the entire width of a recording medium, which is a medium subjected to ink ejection, in the direction substantially perpendicular to the direction for relatively conveying the recording medium.

"Full-line recording head" is normally disposed along the direction perpendicular to the relative conveyance direction of the recording medium. However, an embodiment is possible in which the recording head is disposed along an oblique direction forming a predetermined angle, with respect to the direction perpendicular to the conveyance direction. Moreover, an embodiment is possible in which a long recording head can be obtained by combining a plurality of short recording head blocks having nozzle rows that are shorter than the length corresponding to the entire width of the recording medium, thereby configuring the nozzle rows as the whole group of blocks corresponding to the entire width of the recording medium.

"Recording medium" is a medium (an object that may be referred to as medium subjected to ink ejection, print medium, printed medium, medium subjected to image formation, recording medium, image-receiving medium and the like) which receives the recording of an image through an operation of the recording head, and includes continuous paper, cut paper, seal paper, resin sheets such as OHP sheets, film, cloth, print substrate on which a wiring pattern and the like is formed by an inkjet recording apparatus, intermediate transfer medium, and various other media without regard to materials or shapes. It should be noted that a term "print" appearing in the present specification describes the concept of forming images that are meant in a broad sense, including characters.

The conveyance device for causing the recording medium and the recording head to move relative to each other may include a mode where the recording medium is conveyed with respect to a stationary (fixed) ejection head, or a mode where a ejection head is moved with respect to a stationary recording medium, or a mode where both the ejection head and the recording medium are moved.

According to the present invention, since the individual electrodes of the plurality of piezoelectric elements disposed in one pressure chamber are separated, control of the drive can be performed on each element. According to this configuration, by controlling the drive phases, drive timings, drive waveforms and the like of the plurality of piezoelectric elements, and improvement of the ejection efficiency can be achieved, and control of the amount of liquid droplets to be ejected, and control of the spatter direction (ejection direction) of the liquid droplets are possible, or acoustic crosstalk can be prevented. Further, a piezoelectric element which is not driven can be utilized as a pressure determination sensor so that an ejection failure can be detected. Consequently, maximization of the function and density of the head can be realized.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Entire Configuration of Inkjet Recording Apparatus

Figure 1:
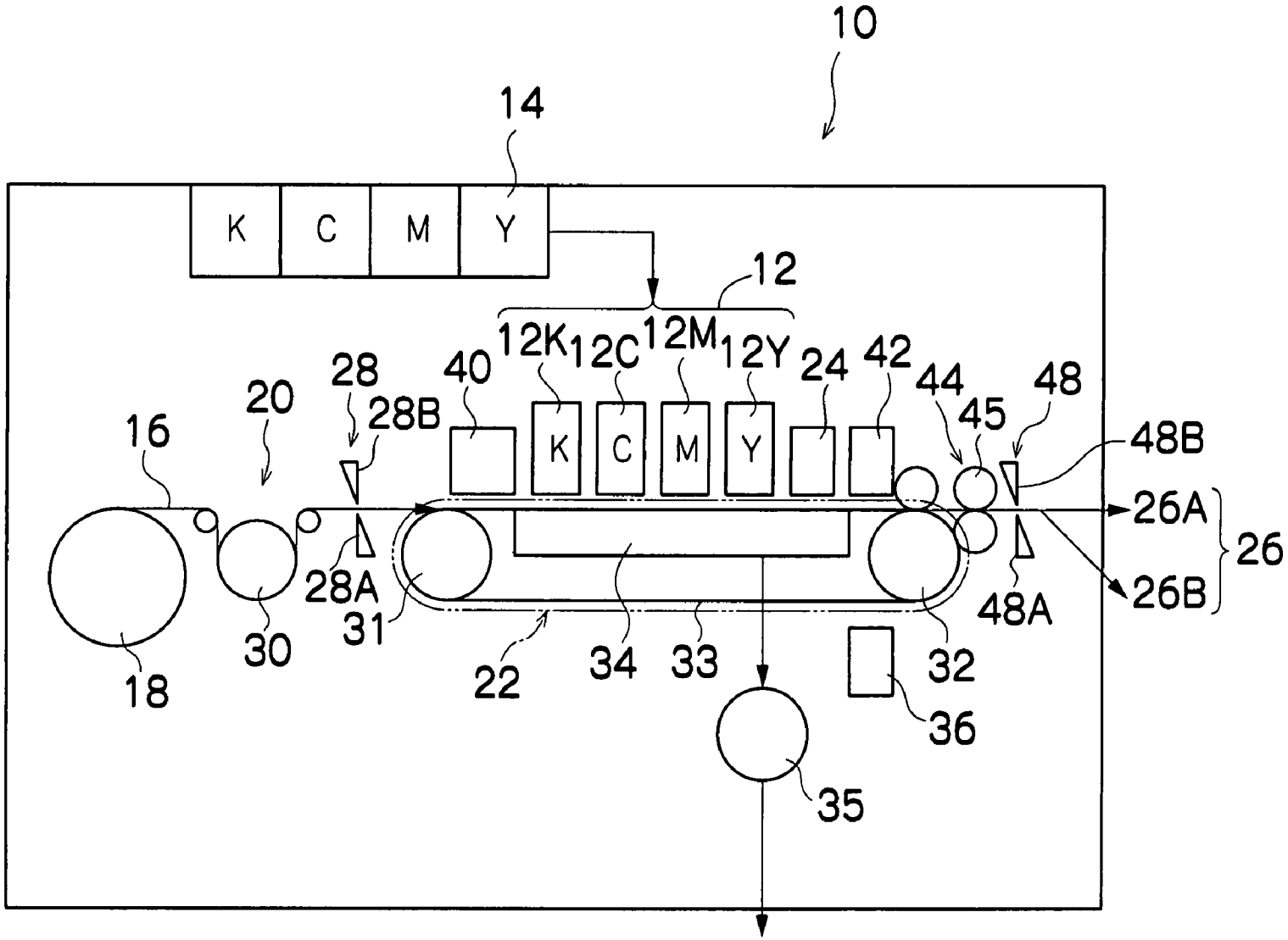
FIG. 1 is a figure of an entire configuration of an inkjet recording apparatus according to an embodiment of the present invention.

FIG. 1 is a figure of an entire configuration of an inkjet recording apparatus in which is employed the liquid ejection head according to an embodiment of the present invention. As shown in the figure, the inkjet recording apparatus 10 comprises: a printing unit 12 having a plurality of inkjet heads (referred to as heads hereinafter) 12K, 12C, 12M, and 12Y provided for ink colors of black (K), cyan (C), magenta (M), and yellow (Y), respectively; an ink storing/loading unit 14 for storing inks to be supplied to the heads 12K, 12C, 12M, and 12Y respectively; a paper supply unit 18 for supplying a recording paper 16 which is a recording medium (a medium subjected to ink ejection); a decurling unit 20 for removing curl in the recording paper 16; a suction belt conveyance unit 22 disposed facing the nozzle face (ink ejection face) of the printing unit 12, for conveying the recording paper 16 while keeping the recording paper 16 flat; a printing determination unit 24 for reading the printed result produced by the printing unit 12; and a paper output unit 26 for outputting recorded recording paper (printed matter) to the exterior.

The ink storing and loading unit 14 has ink tanks for storing the inks of K, C, M and Y to be supplied to the heads 12K, 12C, 12M, and 12Y, and the tanks are connected to the heads 12K, 12C, 12M, and 12Y by means of prescribed channels. The ink storing and loading unit 14 has a warning device (for example, a display device or an alarm sound generator) for warning when the remaining amount of any ink is low, and has a mechanism for preventing loading errors among the colors.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of recording medium to be used (type of medium) is automatically determined, and ink-droplet ejection is controlled so that the ink-droplets are ejected in an appropriate manner in accordance with the type of medium.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, of which length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut papers are used, the cutter 28 is not required.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1. The suction chamber 34 provides suction with a fan 35 to generate a negative pressure, and the recording paper 16 is held on the belt 33 by suction.

The belt 33 is driven in the clockwise direction in FIG. 1 by the motive force of a motor 188 (shown in FIG. 18) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
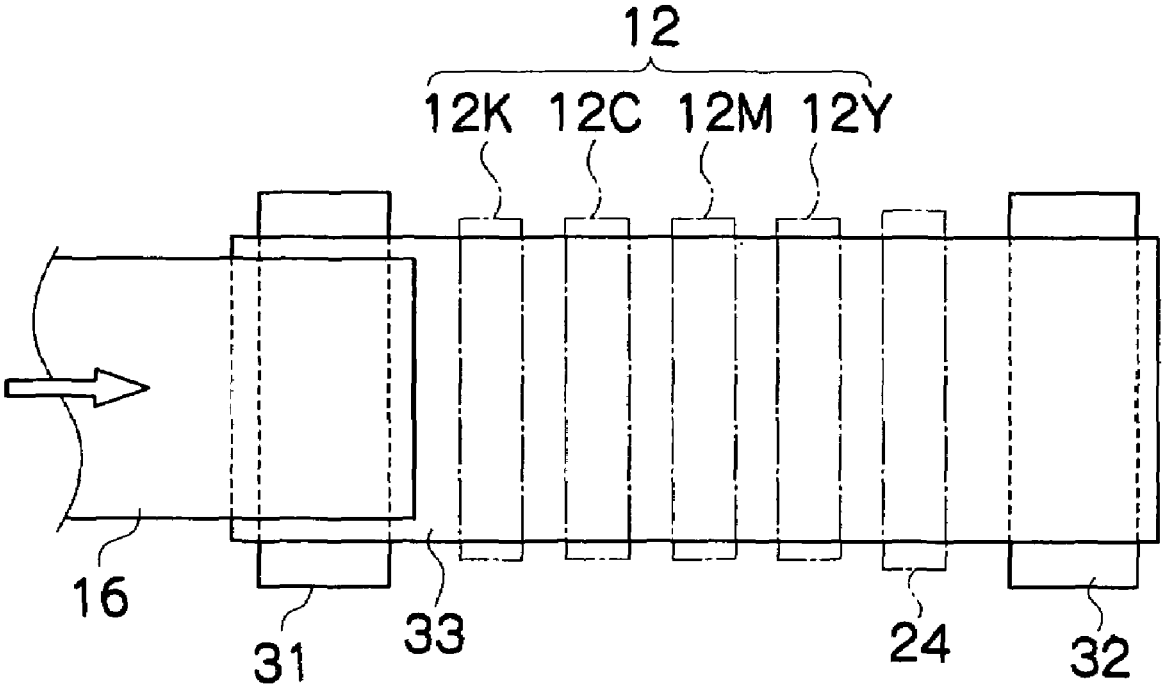
FIG. 2 is a plan view of a substantial part in the vicinity of a printing unit of the inkjet recording apparatus shown in FIG. 1.

The heads 12K, 12C, 12M and 12Y of the printing unit 12 are full line heads having a length corresponding to the maximum width of the recording paper 16 used with the inkjet recording apparatus 10, and comprising a plurality of nozzles for ejecting ink arranged on a nozzle face through a length exceeding at least one edge of the maximum-size recording medium (namely, the full width of the printable range) (see FIG. 2).

The print heads 12K, 12C, 12M and 12Y are arranged in color order (black (K), cyan (C), magenta (M), yellow (Y)) from the upstream side in the feed direction of the recording paper 16, and these respective heads 12K, 12C, 12M and 12Y are fixed extending in a direction substantially perpendicular to the conveyance direction of the recording paper 16.

A color image can be formed on the recording paper 16 by ejecting inks of different colors from the heads 12K, 12C, 12M and 12Y, respectively, onto the recording paper 16 while the recording paper 16 is conveyed by the suction belt conveyance unit 22.

By adopting a configuration in which the full line heads 12K, 12C, 12M and 12Y having nozzle rows covering the full paper width are provided for the respective colors in this way, it is possible to record an image on the full surface of the recording paper 16 by performing just one operation of relatively moving the recording paper 16 and the printing unit 12 in the paper conveyance direction (the sub-scanning direction), in other words, by means of a single sub-scanning action. Higher-speed printing is thereby made possible and productivity can be improved in comparison with a shuttle type head configuration in which a recording head reciprocates in the main scanning direction.

Although the configuration with the KCMY four standard colors is described in the present embodiment, combinations of the ink colors and the number of colors are not limited to those. Light inks, dark inks or special color inks can be added as required. For example, a configuration is possible in which inkjet heads for ejecting light-colored inks such as light cyan and light magenta are added. Furthermore, there are no particular restrictions of the sequence in which the heads of respective colors are arranged.

The print determination unit 24 shown in FIG. 1 has an image sensor for capturing an image of the ink-droplet deposition result of the printing unit 12, and functions as a device to check for ejection defects such as clogs of the nozzles in the printing unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the heads 12K, 12C, 12M, and 12Y This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

A test pattern or the target image printed by the print heads 12K, 12C, 12M, and 12Y of the respective colors is read in by the print determination unit 24, and the ejection performed by each head is determined. The ejection determination includes determination of the ejection, measurement of the dot size, and measurement of the dot formation position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, the paper output unit 26A for the target prints is provided with a sorter for collecting prints according to print orders.

Structure of Head

Next, the structure of a head will be described. The heads 12K, 12C, 12M and 12Y of the respective ink colors have the same structure, and a reference numeral 50 is hereinafter designated to any of the heads.

Figure 3A:
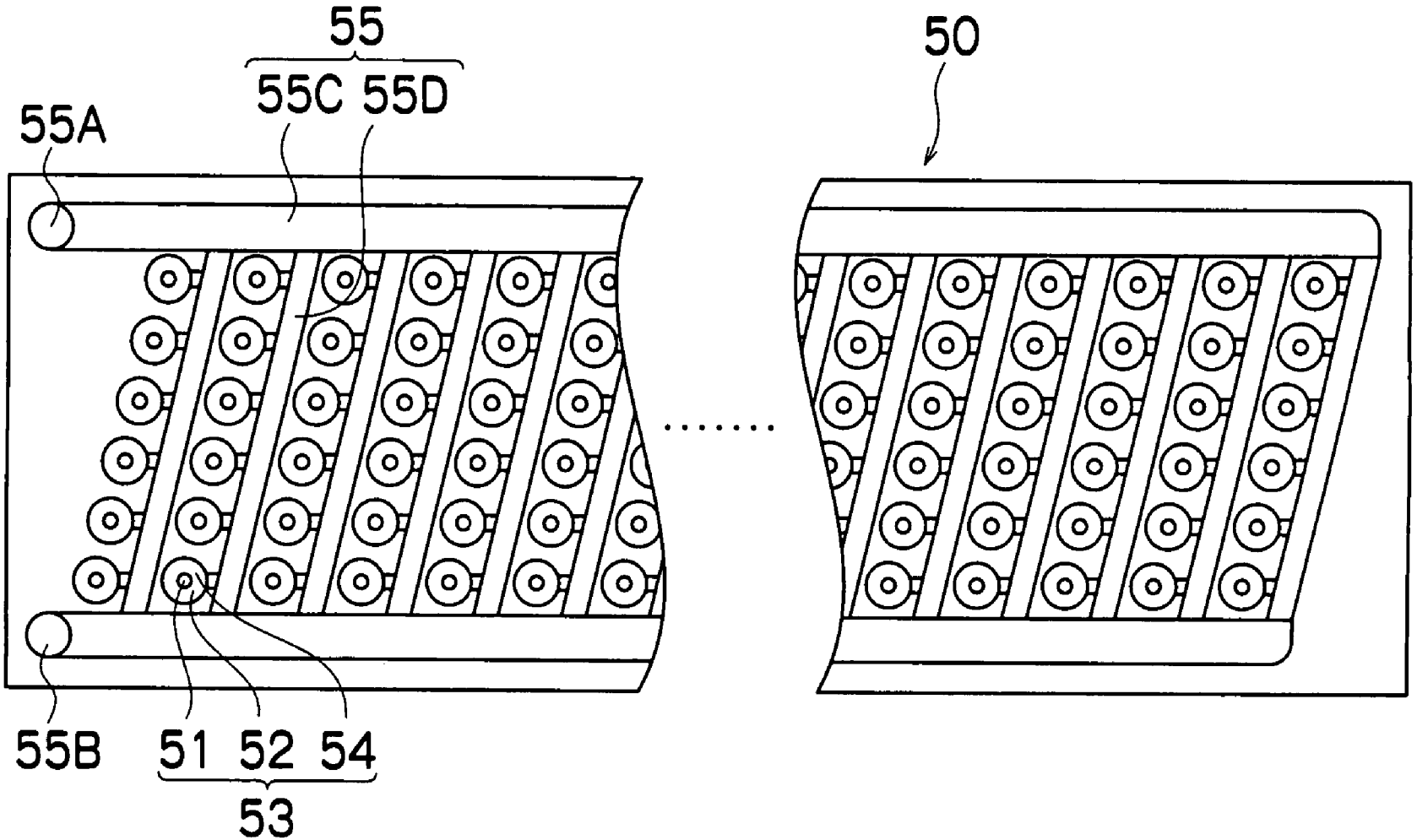
FIG. 3A is a plan perspective view showing an example of the composition of a head.
Figure 3B:
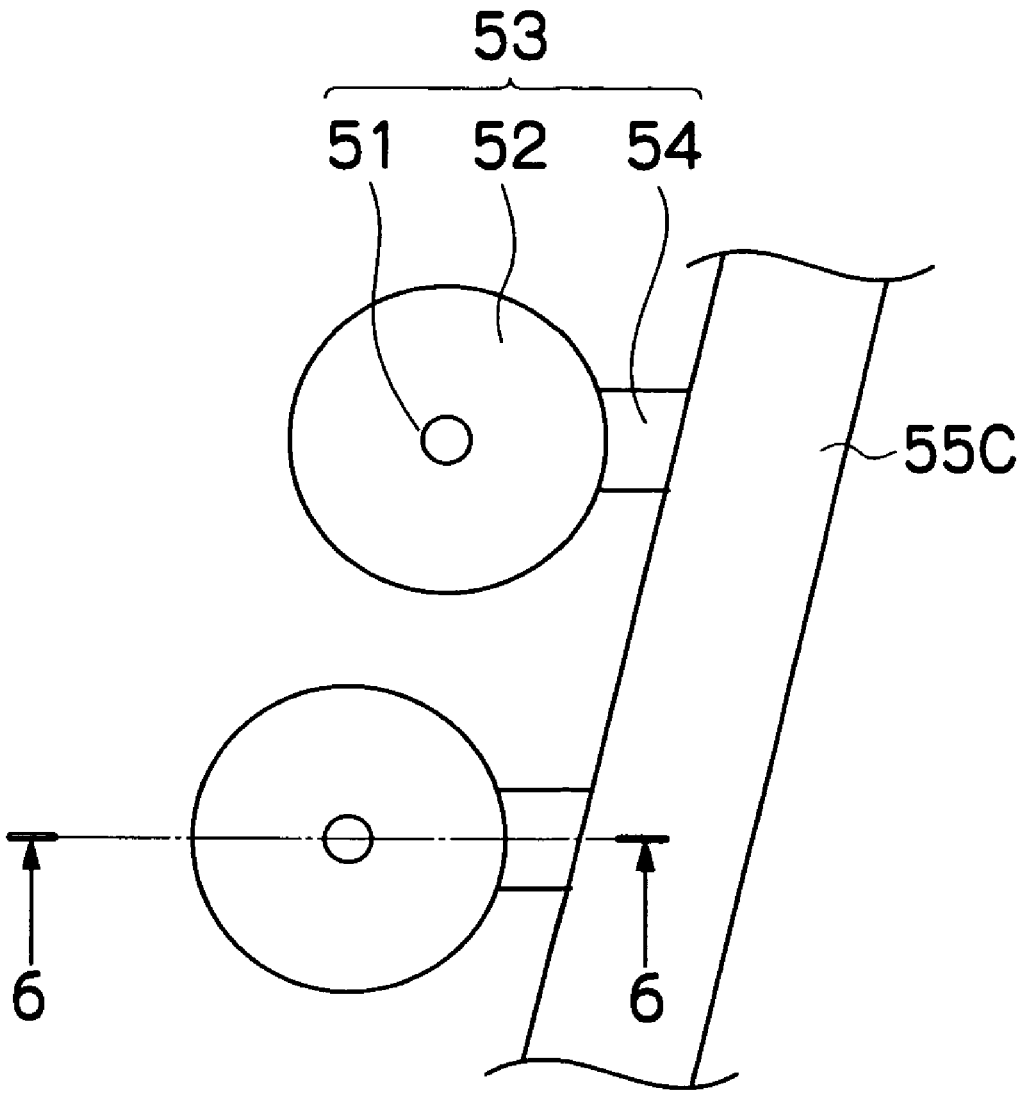
FIG. 3B is a diagram showing an enlarged portion of FIG. 3A.

FIG. 3A is a plan perspective view showing the composition of a head 50, and FIG. 3B is a diagram showing an enlarged portion of the head 50. The density of the nozzle pitch in the head 50 needs to be maximized in order to maximize the density of the dots printed on the recording paper 16. As shown in FIG. 3A, the head 50 in the present embodiment has a structure in which a plurality of ink chamber units (liquid droplets ejection elements) 53 having nozzles (same as liquid ejection ports) 51 as ejection ports for ejecting ink-droplets and pressure chambers 52 corresponding to the nozzles 51 are disposed in the form of a staggered matrix (in a two-dimensional form). According to this structure, the density of the substantial nozzle intervals (projected nozzle pitches) projected so as to follow the longitudinal direction of the head (direction perpendicular to the paper conveyance direction) is achieved. It should be noted in FIG. 3A that, for convenience in construction of the figure, some of the nozzles (the number of ink chamber units 53) are omitted.

Each of the pressure chambers 52 is communicated with a common flow passage 55 via an individual supply channel 54. The common flow passage 55 is communicated with an ink tank 160 (not shown in FIG. 3A, but shown in FIG. 17) as an ink supply source via connection ports 55A, 55B, and ink supplied from the ink tank 160 is distributed and supplied to each of the pressure chambers 52 via the common flow passage 55 shown in FIG. 3A. It should be noted that reference symbol 55C in FIG. 3A indicates the mainstream of the common flow passage 55, and reference symbol 55D indicates a subsidiary stream diverging from the mainstream 55C.

Figure 6:
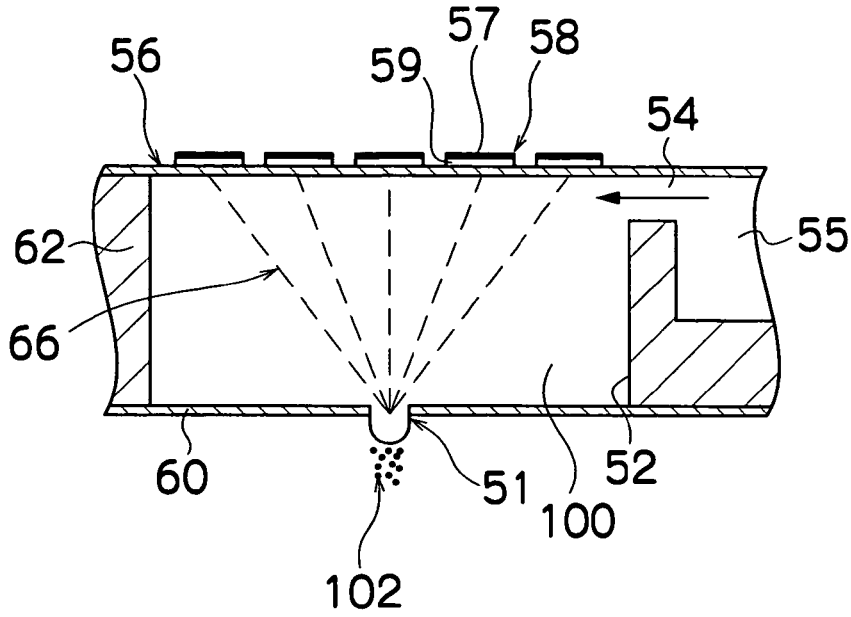
FIG. 6 is a cross sectional view taken along line 6-6 in FIG. 3B.
Figure 7:
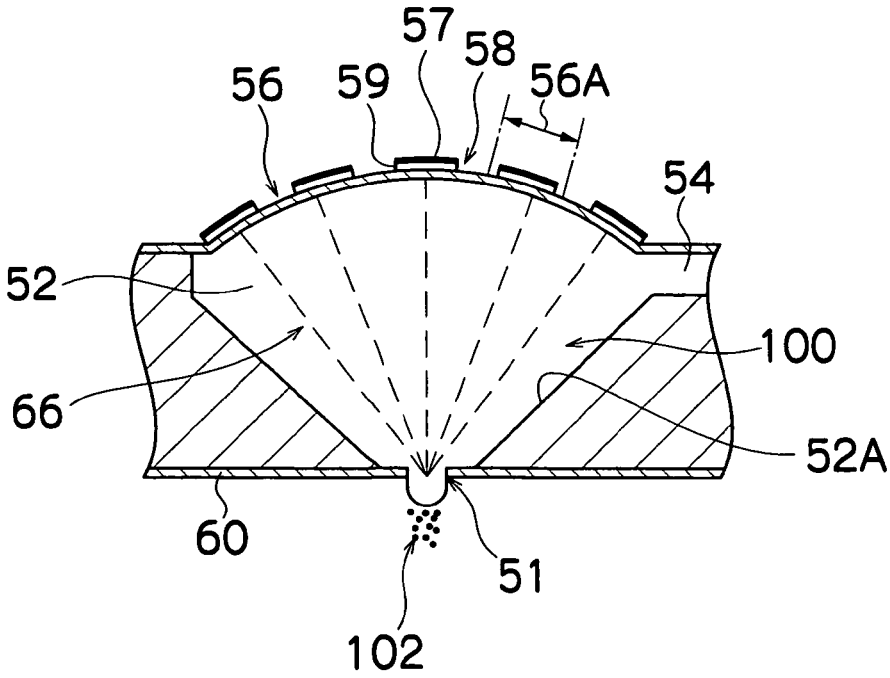
FIG. 7 is a cross sectional view showing another configuration example of an ink chamber unit.
Figure 8:
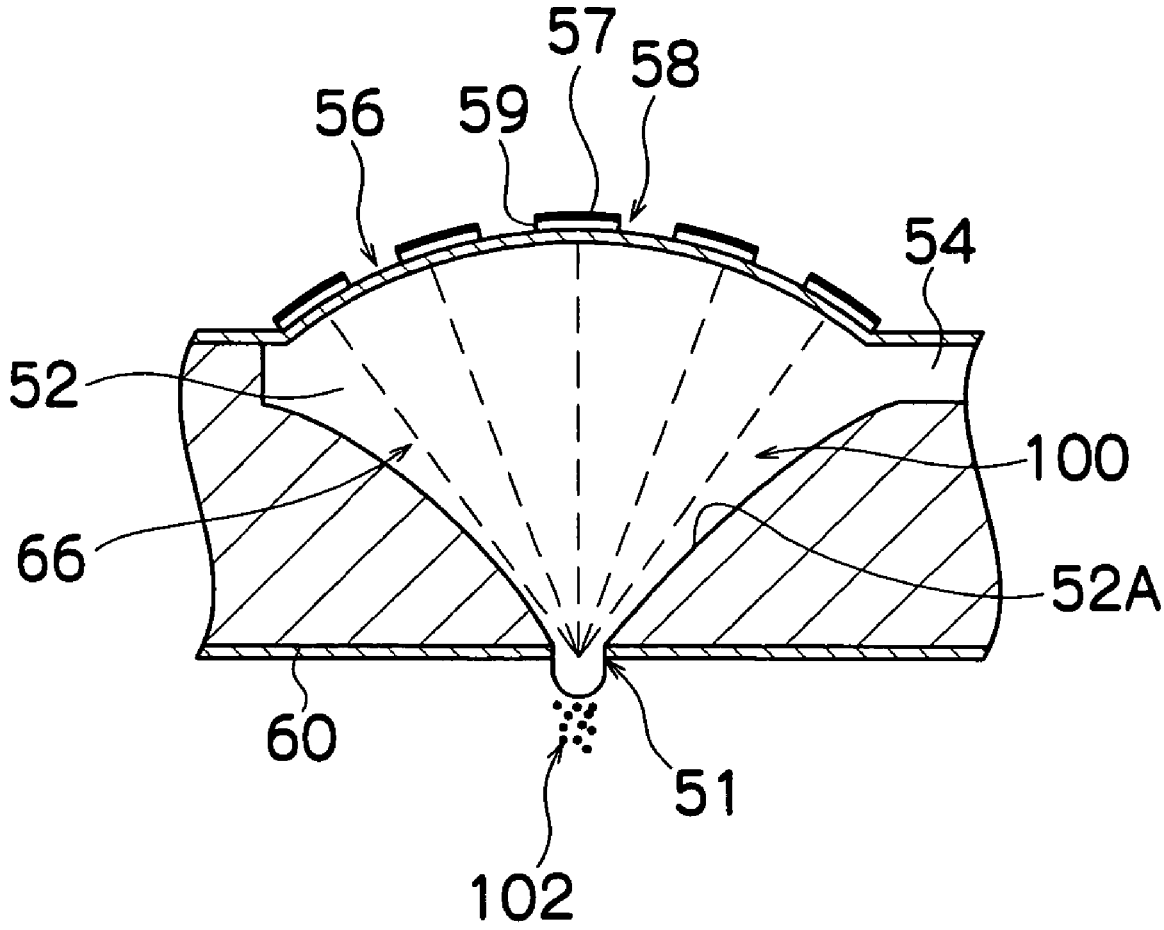
FIG. 8 is a cross sectional view showing another configuration example of an ink chamber unit.

The planar shape (the projection shape when projecting the face parallel with the nozzle face) of the pressure chamber 52 shown in the figure is substantially in the form of a circle, but the shape of the pressure chamber is not particularly limited in the implementation of the present invention, thus it may be any one of various forms such as a quadrilateral shape including a square, rectangle, rhombus, and the like, a hexagonal shape, octagonal shape and other polygonal shapes, or an elliptical shape. The three-dimensional structure of the ink chamber unit 53 is described below in detail (FIG. 6 through FIG. 8).

Figure 4:
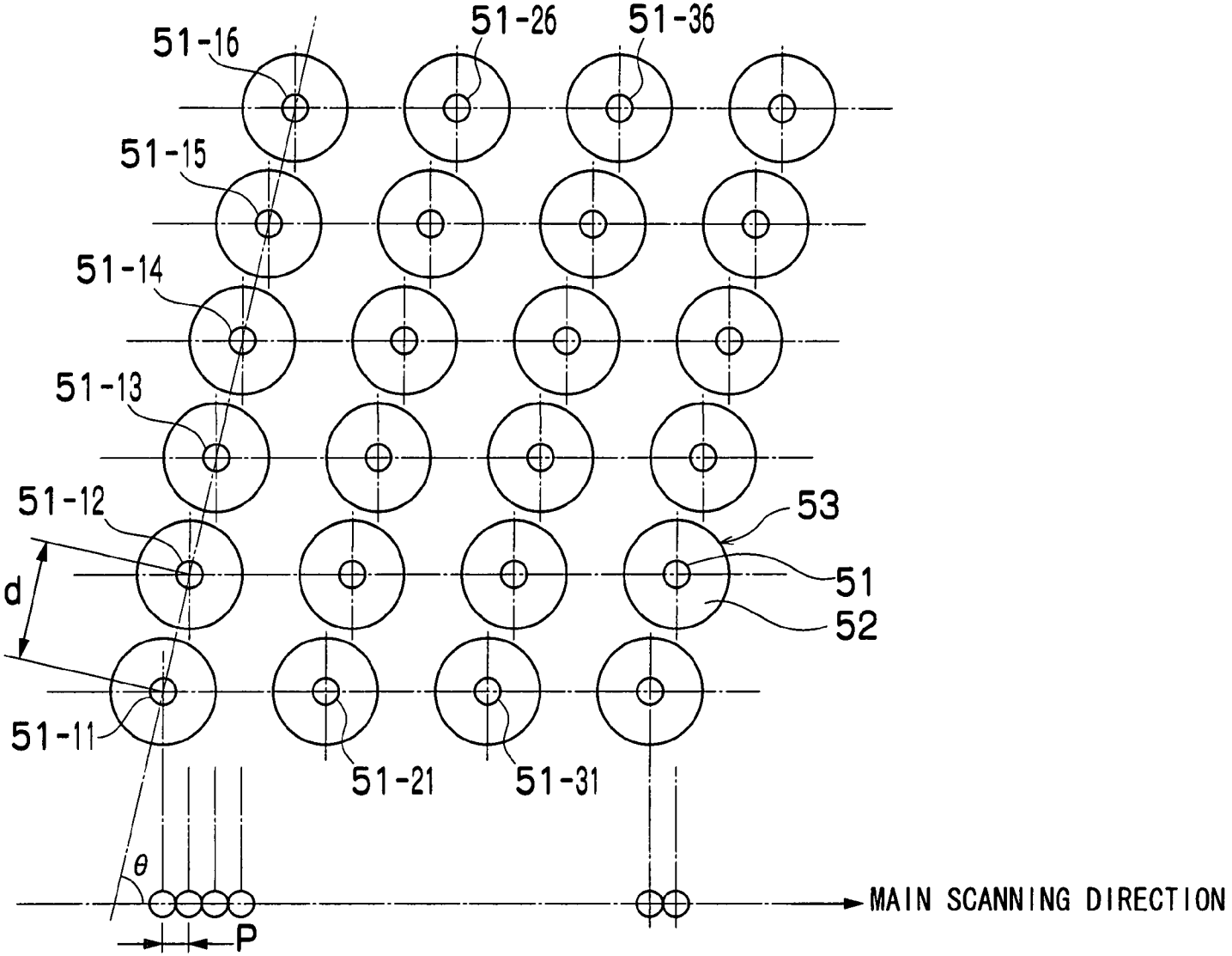
FIG. 4 is an enlarged view showing a nozzle arrange in the head shown in FIG. 3A.

As shown in FIG. 4, the plurality of ink chamber units 53 are arranged in a grid with a fixed arrangement pattern in the line-printing direction along the main scanning direction and in the diagonal-row direction forming a fixed angle θ that is not a right angle with the main scanning direction, whereby density maximization of the nozzle head according to the present embodiment can be realized.

More specifically, by adopting a structure in which a plurality of ink chamber units 53 are arranged at a uniform pitch d in line with a direction forming an angle of θ with respect to the main scanning direction, the pitch P of the nozzles projected so as to align in the main scanning direction is d×cos θ, and hence the nozzles 51 can be regarded to be equivalent to those arranged linearly at a fixed pitch P along the main scanning direction. Such configuration results in a nozzle structure in which the nozzle row projected in the main scanning direction has a high nozzle density of up to 2,400 nozzles per inch.

In a full-line head comprising rows of nozzles that have a length corresponding to the entire width of the image recordable width, the "main scanning" is defined as printing one line (a line formed of a row of dots, or a line formed of a plurality of rows of dots) in the width direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 51 arranged in a matrix such as that shown in FIG. 4 are driven, the main scanning according to the above-described (3) is preferred. More specifically, the nozzles 51-11, 51-12, 51-13, 51-14, 51-15 and 51-16 are treated as a block (additionally; the nozzles 51-21, . . . , 51-26 are treated as another block; the nozzles 51-31, . . . , 51-36 are treated as another block; . . . ); and one line is printed in the width direction of the recording paper 16 by sequentially driving the nozzles 51-11, 51-12, . . . , 51-16 in accordance with the conveyance velocity of the recording paper 16.

On the other hand, the "sub-scanning" is defined as to repeatedly perform printing of one line (a line formed of a row of dots, or a line formed of a plurality of rows of dots) formed by the main scanning, while moving the above-described full-line head and the paper relatively to each other.

Figure 5:
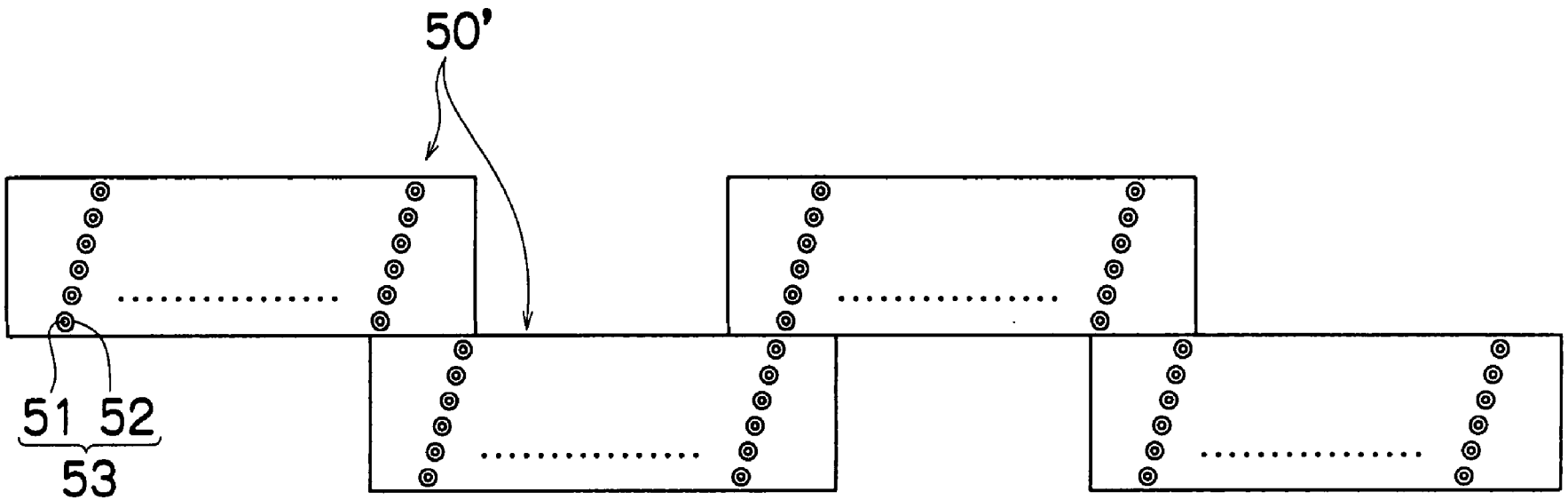
FIG. 5 is a plan perspective view showing an example of other composition of a full-line head.

In the implementation of the present invention, the structure of the nozzle arrangement is not particularly limited to the examples shown in the drawings. Moreover, the embodiment of the full-line head comprising nozzle rows disposed along a length corresponding to the entire width of the recording paper 16 in the direction substantially perpendicular to the conveyance direction of the recording paper 16 is not limited to the present embodiment. For example, instead of the configuration shown in FIG. 3A, a long full-line head, which has nozzle rows having a length corresponding to the entire width of the recording paper 16, may be composed by connecting a plurality of short head blocks 50' in which a plurality of nozzles 51 are arrayed two-dimensionally, and arranging them in a staggered form, as shown in FIG. 5.

FIG. 6 is a cross sectional view (cross sectional view taken along line 6-6 in FIG. 3B) showing an example of the three-dimensional configuration of a single liquid droplets ejection element (the ink chamber unit 53 corresponding to a single nozzle 51).

As shown in FIG. 6, the pressure chamber 52 is communicated with the common flow passage 55 via the individual supply channel 54, ink 100 is supplied from the common flow passage 55 to the pressure chamber 52, and the ink is filled into the pressure chamber 52. A plurality of piezoelectric elements having individual electrodes 57 are provided on the surface (surface at the upper side in FIG. 6) of a diaphragm 56 configuring a surface of the pressure chamber 52 (top face in FIG. 6) opposite from the pressure chamber. The diaphragm 56 is also used as a common electrode of the piezoelectric element 58.

The examples shown in the figure illustrates a structure in which a piezoelectric substance 59 and the individual electrode 57 configuring each of the piezoelectric elements 58 are separated in the individual element, but a structure is possible in which a layer of piezoelectric substance is taken as a single substance (single layer) instead of separating it in each element, and, by separating the individual electrode, a plurality of piezoelectric elements having the piezoelectric substrate as an active portion in the area of the individual electrode.

In this manner, the plurality of piezoelectric elements 58 which can be driven individually are obtained by separating the piezoelectric substance 59 itself, or by separating the individual electrode 57 while keeping the piezoelectric substance layer as a single substance, and the thickness of the piezoelectric substance 59 is reduced to raise a resonance point, and further the piezoelectric elements 58 are driven at high frequency (frequency for causing ultrasonic vibration, e.g., 100 kHz through 100 MHz). The thickness of the piezoelectric substance 59 is preferably one-fourth or one-half of the sonic wavelength (in the piezoelectric substance 59) of the drive frequency.

A nozzle plate 60 in which an opening of the nozzle 51 is formed is disposed on the lower surface side of the pressure chamber 52. Reference symbol 62 in FIG. 6 is a flow passage forming member which configures a partition wall portion of the pressure chamber 52. In the configuration shown in the figure, the piezoelectric substance 59 is deformed by applying drive voltage to the individual electrode 57 of each of the piezoelectric elements 58, and the ink inside the pressure chamber 52 is applied with pressure via the diaphragm 56.

In the present embodiment, pressure is applied in a direction perpendicular to the surface of the diaphragm 56 (surface of the piezoelectric substance 59) using displacement vibration in the direction of the thickness of the piezoelectric substance 59. By displacing the drive phase of the plurality of piezoelectric elements 58 provided in a single pressure chamber 52 to drive each of the piezoelectric elements 58 ultrasonically, the movement direction (direction of the broken lines indicated with reference symbol 66 in FIG. 6) of the associated wave surface of the pressure wave having frequency of the ultrasonic wave is concentrated into the vicinity of the nozzle 51. Accordingly, mist-like minuscule liquid droplets (ink mist) 102 are ejected from the nozzle 51.

FIG. 6 shows an example of the configuration the plurality of flat piezoelectric elements 58 are formed in the flat diaphragm 56, but in the implementation of the present invention various embodiments other than the example of FIG. 6 are possible.

FIG. 7 and FIG. 8 are cross sectional views showing other configuration examples of the ink chamber unit 53. In FIG. 7 and FIG. 8, the same or like reference symbols are used to indicate the same or like portions in FIG. 6, thus the overlapping explanations are omitted accordingly. The example in FIG. 7 shows a configuration in which the diaphragm 56 and the piezoelectric elements 58 are disposed on a curved surface (a substantially cylindrical surface or substantially spherical surface, with the nozzle portion at the center) such that the pressure wave generated by the piezoelectric elements 58 are concentrated into the nozzle portion. Specifically, the diaphragm 56 in FIG. 7 has a polygonal shape partially having flat regions 56A, and is formed so as to basically fit with the cylindrical or spherical surface of the circle with the nozzle portion at the center. The flat piezoelectric elements 58 are disposed in the flat regions 56A in the diaphragm 56, in which when a drive signal is applied to the individual electrode 57 of each of the piezoelectric elements 58, each of the regions 56A of the diaphragm 56 is caused to vibrate in the direction perpendicular to the surface of the diaphragm 56.

Furthermore, an inclined shape (for example, as shown in the figure, the cross section is in the shape of a funnel so as to change linear functionally along with the distance of axis) in which the cross sectional area thereof gradually becomes small towards the nozzle 51 is formed on an inner wall 52A of the pressure chamber 52 between the diaphragm 56 and the nozzle 51. The pressure wave can be concentrated efficiently in the vicinity of the nozzle portion by means of this inclined shape.

The configuration shown in FIG. 8 is also possible instead of the configuration of FIG. 7. Specifically, the example shown in FIG. 8 shows a configuration in which the diaphragm 56 and the piezoelectric elements 58 are formed into a curved shape (a substantially cylindrical surface or substantially spherical surface, with the nozzle portion at the center) such that the pressure wave generated by the piezoelectric elements 58 are concentrated into the nozzle portion. Specifically, the diaphragm 56 is formed into a shape with a cylindrical spherical surface, with the nozzle portion at the center, and the piezoelectric element 58 composed of the curved piezoelectric substance 59 and individual electrode 57 is formed along this diaphragm surface.

Furthermore, an inclined shape (for example, as shown in the figure, the cross section is in the form of an exponential curve so as to change exponentially along with the distance of axis) in which the cross sectional area thereof gradually becomes small towards the nozzle 51 is formed on an inner wall 52A of the pressure chamber 52 between the diaphragm 56 and the nozzle 51. Of course, a configuration is possible in which the shape of the inner wall 52A of the pressure chamber 52 which is in the form of an exponential curve in FIG. 8 is replaced with a funnel shape as shown in FIG. 7, or contrary, a configuration is possible in which the shape of the inner wall 52A of the pressure chamber 52 which is in the form of a funnel is replaced with the exponential curve shape as shown in FIG. 8.

In the configuration shown in FIG. 7 or FIG. 8, when the plurality of piezoelectric elements 58 are driven ultrasonically at the same phase, the pressure wave generated by each of the piezoelectric elements 58 is concentrated into the nozzle portion, and large displacement can be provided to the ink in the vicinity of the nozzle 51.

Figure 9A:
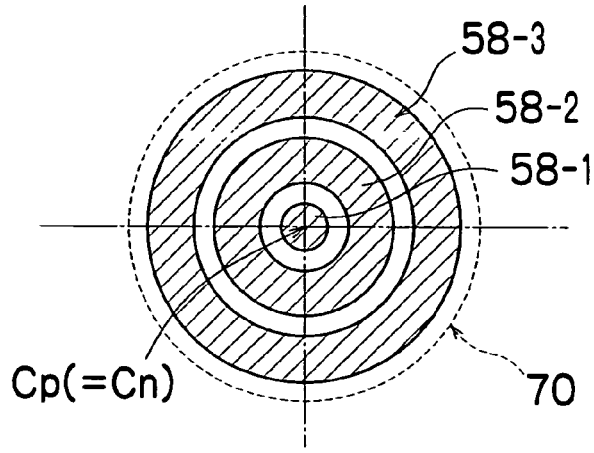
FIGS. 9A to 9C are plan views showing an example of arrangement of a group of piezoelectric elements formed on a diaphragm.
Figure 9B:
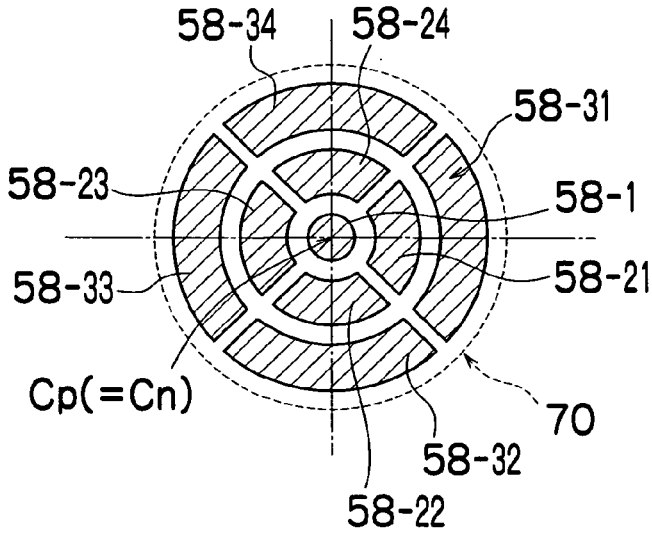
Figure 9C:
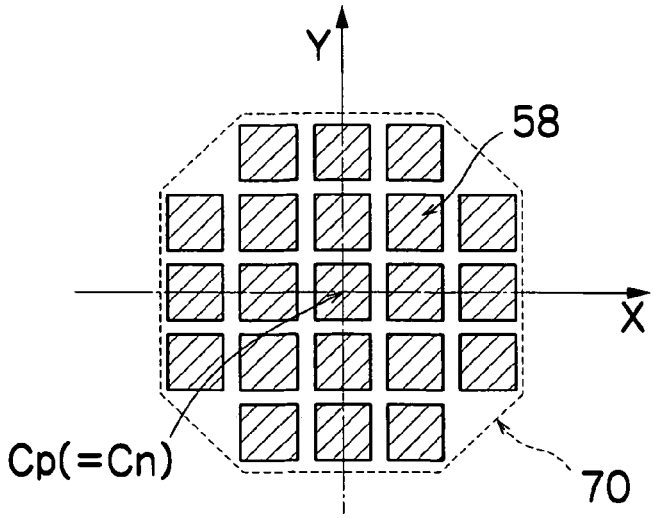

FIGS. 9A through 9C are plan views showing examples of arrangement of the piezoelectric elements formed on the diaphragm 56. The region surrounded with a dotted line indicated with reference symbol 70 in the figures indicates a region of the diaphragm 56 (used along with the common electrode) corresponding to the pressure chamber 52 (referred to as "pressure chamber area" hereinafter), and the portion indicated with diagonal lines in the figures indicates a region of the piezoelectric substance 59 and individual electrode 57 which function as the piezoelectric element 58 (see FIG. 6 through FIG. 8).

In each of the examples in FIGS. 9A through 9C, the pressure chamber center (the center of the pressure chamber area 70, i.e. the centers of the arranged piezoelectric elements) Cp matches with the nozzle center Cn, and the plurality of piezoelectric elements 58 are disposed to create rotational symmetry about an axis of symmetry which is a straight line perpendicular to the paper which passes through the nozzle center in the pressure chamber area 70.

FIG. 9A shows an example of arrangement of piezoelectric elements which are broken up into concentric circles. In the illustrated example, in the pressure chamber area 70, a circular piezoelectric element 58-1 and ring-like piezoelectric elements 58-2, 58-3 are disposed concentrically, with the nozzle center Cn at the center of the circle.

FIG. 9B shows an example of arrangement of piezoelectric elements which are broken up into concentric circles in the circumferential direction. In the illustrated example, the ring-like piezoelectric elements 58-2 and 58-3 of FIG. 9A are further broken up into four portions at substantially 90 degrees in the circumferential direction to form partially-circular piezoelectric elements 58-2*i*, 58-3*i* (here, i=1, 2, 3, 4), which are arranged so as to create rotational symmetry (quarter rotational symmetry) of 90 degrees. When braking up the ring-like piezoelectric elements 58-2 and 58-3 in the circumferential direction, they may be broken up into at least two portions, but the number of broken pieces is not particularly limited.

FIG. 9C shows an example of arrangement of piezoelectric elements which are broken up into squares. In the illustrated example, in the pressure chamber area 70 of which planar shape is octagonal, the piezoelectric elements 58 substantially in the form of a square are arranged in matrix so as to conform to the shape of the pressure chamber area 70. As shown in the figure, the plurality of piezoelectric elements 58 are arrayed on a square lattice along the direction of x-axis (same as a first direction) and the direction of y-axis (same as a second direction) perpendicular to the x-axis on the diaphragm surface. Any of the examples of arrangement shown in FIGS. 9A through 9C can be said to be an embodiment of arrangement in which the arrangement has rotational symmetries with respect the axis of symmetry which is perpendicular to the paper which passes through the pressure chamber center Cp (nozzle center Cn), and is axisymmetrical with respect to the x-axis and the y-axis perpendicular to the x-axis.

Figure 10A:
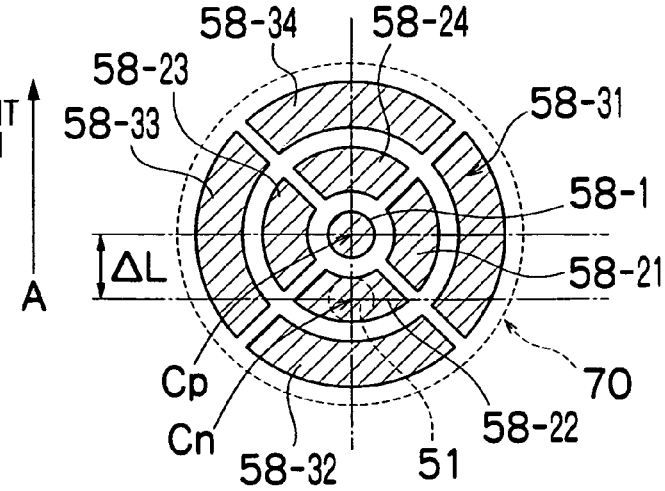
FIGS. 10A to 10C are plan views showing another example of arrangement of a group of piezoelectric elements formed on the diaphragm.
Figure 10B:
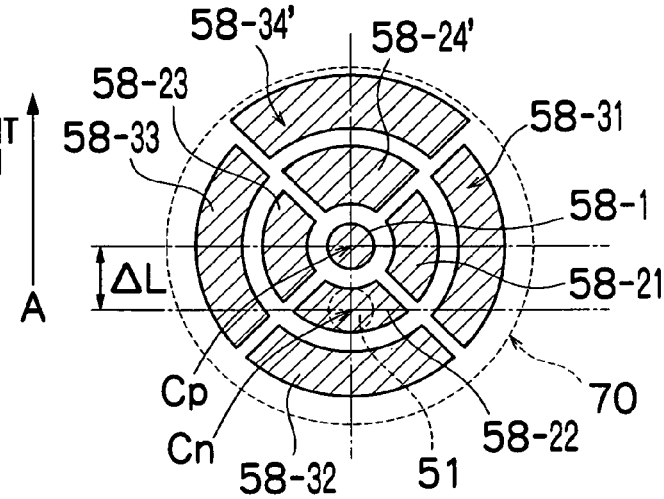
Figure 10C:
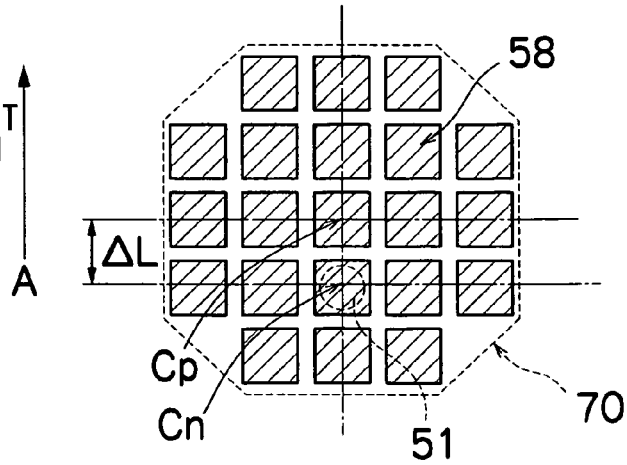

FIGS. 9A through 9C describe a configuration in which the pressure chamber center (the centers of the piezoelectric elements) Cp is matched with the nozzle center Cn. However, as shown in FIGS. 10A through 10C, a configuration is possible in which the pressure chamber center (the centers of the piezoelectric elements) Cp and the nozzle center Cn are displaced. It should be noted that in FIGS. 10A through 10C like reference symbols are used to indicate the same or like portions as those in FIGS. 9A through 9C, thus the overlapping explanations are omitted accordingly.

In FIGS. 10A through 10C, as indicated with arrow A, the recording medium (recording paper 16 of FIG. 1) moves from the bottom toward the top of the figure. As shown in FIGS. 10A through 10C, the nozzle center Cn in the pressure chamber area 70 is offset from pressure chamber center (the centers of the piezoelectric elements) Cp to the upstream side (lower side in the figure) of the movement direction of the recording medium by a predetermined distance ΔL.

Specifically, in the example of FIG. 10A, the nozzle center Cn is shifted in the direction opposite to the movement direction of the recording medium, as compared to the configuration described with reference to FIG. 9B. FIG. 10B is an example with the configuration where the nozzle center Cn is shitted, in which the piezoelectric elements having a larger area are arranged on the side toward which the recording medium moves (the downstream side in the movement direction of the recording medium) in the pressure chamber area 70. That is, instead of the piezoelectric elements 58-24 and 58-34 in the configuration of FIG. 10A, piezoelectric elements 58-24' and 58-34' which respectively have the large areas are disposed as shown in FIG. 10B.

FIG. 10C shows a configuration in which the nozzle center Cn is shifted in the direction opposite to the movement direction of the recording medium, as compared to the configuration described with reference to FIG. 9C, in other words, it shows an example in which more of the piezoelectric elements 58 are arranged in a downstream region in the movement direction of the recording paper in the pressure chamber area 70 with reference to the nozzle center Cn.

In the configurations illustrated in FIGS. 10A through 10C, the drive phase of the group of piezoelectric elements disposed in the pressure chamber area 70 is controlled to cause the pressure wave surface to concentrate into the vicinity of the nozzle which is shifted from the center CP of the pressure chamber area 70, and, as a result, the center of gravity can be shifted toward the direction opposite to the movement direction of the recording medium (upstream direction of the direction of relative movement of the recording medium) to spatter (eject) the ink obliquely.

In the case of ejecting mist-like minuscule droplets of ink by means of ultrasonic vibration, when relative speed of the recording medium and of the head 50 is accelerated in response to a request of printing at a high speed, the spatter direction of the ink is caused to curve because of airstream (wind) associated with the relative movement, thus there is concern that it may affect the precision of droplet deposition.

In this regard, according to the configurations illustrated in FIGS. 10A through 10C, by ejecting obliquely toward the direction (upstream direction) opposite to the movement direction of the recording medium, the droplet deposition position can be controlled.

The piezoelectric elements described in FIG. 6 through FIGS. 10A to 10C can be produced using a thin-film formation method typified by an aerosol deposition method (AD) or sputtering method. Furthermore, the piezoelectric elements broken into a plurality of portions can be produced by means of an etching process, machining process or the like.

In the structures described in FIG. 6 through FIGS. 10A to 10C, not only the plurality of piezoelectric elements 58 are individually vibrated ultrasonically, but also applied simultaneously with a drive waveform with a lower frequency and cause the diaphragm 56 to bend by means of, mainly, bimorph drive to perform an operation for removing the ink, whereby the piezoelectric elements can be used in conjunction with the ejection operation by means of ultrasonic vibration. "Bimorph drive" is a pattern of the driving in which the diaphragm 56 is bent and deformed using the difference in expansion and contraction of the piezoelectric substance 59 and diaphragm 56.

By ejecting the mist-like small ink particles by combining the pressurization operation and ultrasonic vibration by the bimorph drive, the spattering speed (initial speed at the time of ejection) can be improved. Alternatively, when it is necessary to eject large liquid droplets in order to form recording dots of high density, ejection can be performed by the bimorph drive.

In this manner, mist-like small ink particles can be ejected using both phenomena caused by the bimorph drive and ultrasonic vibration, or selectively using either one of the phenomena.

Figure 11:
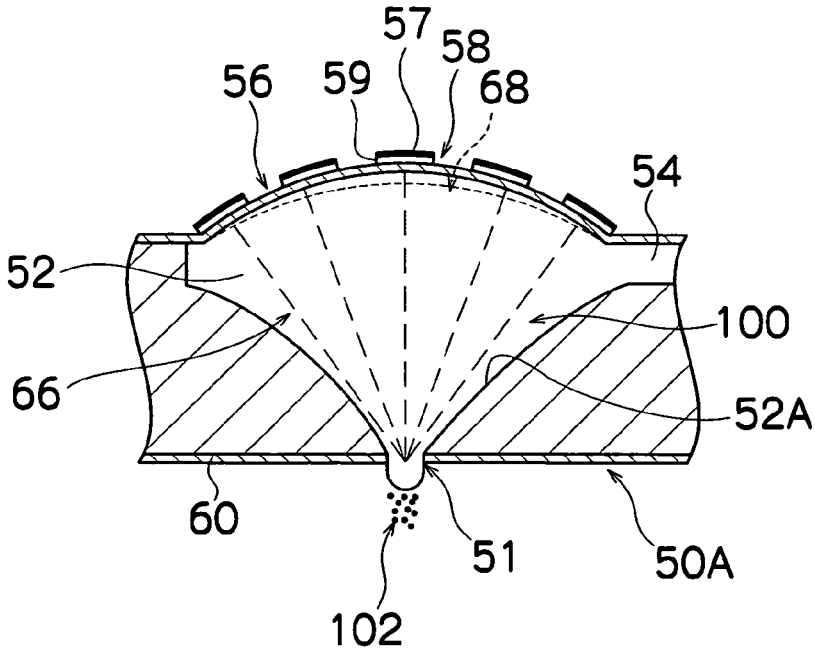
FIG. 11 is a cross sectional view showing an operation by synthetic drive of ultrasonic vibration and vibration with lower frequency.

FIG. 11 is a cross sectional view showing an operation performed through the synthetic drive by ultrasonic vibration and vibration at a frequency lower than that of the ultrasonic wave. This figure is explained based on the example of the configuration described with reference to FIG. 8, and is similar to the configurations of FIG. 6 and FIG. 7. It should be noted that in FIG. 11 the same reference symbols are used to indicate the same portions as in FIG. 8, thus the overlapping explanations are omitted accordingly.

In FIG. 11, when ultrasonically driving the plurality of piezoelectric elements 58 disposed in the region of the diaphragm 56 corresponding to the pressure chamber 52, the pressure wave with ultrasonic frequency is propagated toward the nozzle 51 while hardly causing the diaphragm 56 to be displaced.

On the other hand, when vibration with the lower number of frequency than the ultrasonic vibration is applied simultaneously with the ultrasonic vibration, the diaphragm 56 is displaced as shown with the dotted line indicated with reference numeral 68. The ink 100 is pushed into the pressure chamber 52, and the ink is ejected from the nozzle 51 by the displacement of the diaphragm 56. By applying the ultrasonic vibration following the ejected ink, the spattering speed of the ink mist 102 is raised. If the frequency of the vibration caused by the lower frequency conforms to a resonance point of the head 50, the ink may be discharged only by the vibration with the lower frequency.

Figure 12A:
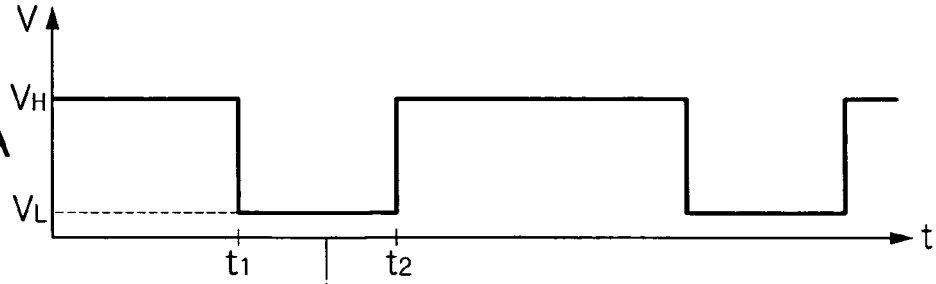
FIGS. 12A and 12B are waveform diagrams showing the print timing of the ultrasonic vibration and the vibration with the lower frequency in the synthetic drive described with reference to FIG. 11.
Figure 12B:
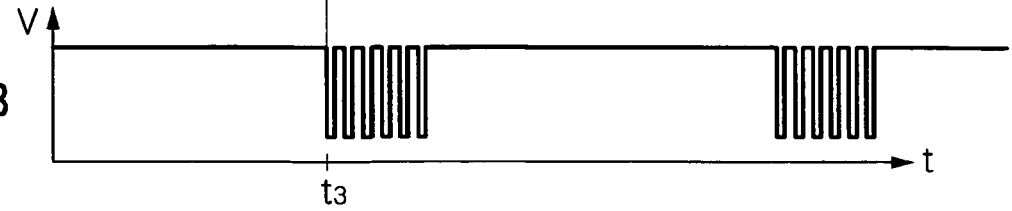

FIGS. 12A and 12B illustrate the print timing of the ultrasonic vibration and the vibration with the lower frequency in the synthetic drive described with reference to FIG. 11. FIG. 12A shows a drive signal generating the vibration of the lower frequency, and FIG. 12B shows a drive signal generating the ultrasonic vibration. In each of the figures, horizontal axis indicates the time, and vertical axis indicates voltage of the drive signal.

As shown in FIG. 12A, the vibration with the lower frequency pushes out the ink when the voltage changes from a high voltage VH to a low voltage VL (time t1), and draws the ink when the voltages returns from the low voltage VL to the high voltage VH (time t2). The ultrasonic vibration in FIG. 12B is added in synchronization with the vibration with the lower frequency.

There is a delay in a certain degree in the actual movement of the ink with respect to the drive of the piezoelectric elements 58. Therefore, in consideration of the deal in the movement of the ink, the timing is delayed from the print timing t1 of the vibration with the lower frequency to add the ultrasonic vibration (time t3). It is preferred that the timing when adding the ultrasonic vibration (t3) be the timing when the leading of the ink comes out of the nozzle face sufficiently. Particularly, it is most preferred that the ultrasonic vibration be added at the timing when the amount (volume) of the leading head of the ink is maximum (timing when the leading position (amount of displacement) of the ink that comes from the nozzle face.

In the configurations described with reference to FIG. 6 through FIGS. 12A to 12B, the volume of the liquid droplets ejected from the nozzle 51 can be varied and multiple values can be output according to the combination obtained when operating the plurality of piezoelectric elements 58 disposed in the single pressure chamber 52, or the number of piezoelectric elements 58 to be driven simultaneously, or alternatively the drive timings of the piezoelectric elements to be operated, or by changing an appropriate combination of them.

Specifically, of the piezoelectric elements 58 disposed in the single pressure chamber 52, by controlling the number of elements to be driven or the drive timings thereof, the ejection power (ejection energy) can be changed.

Figure 19:
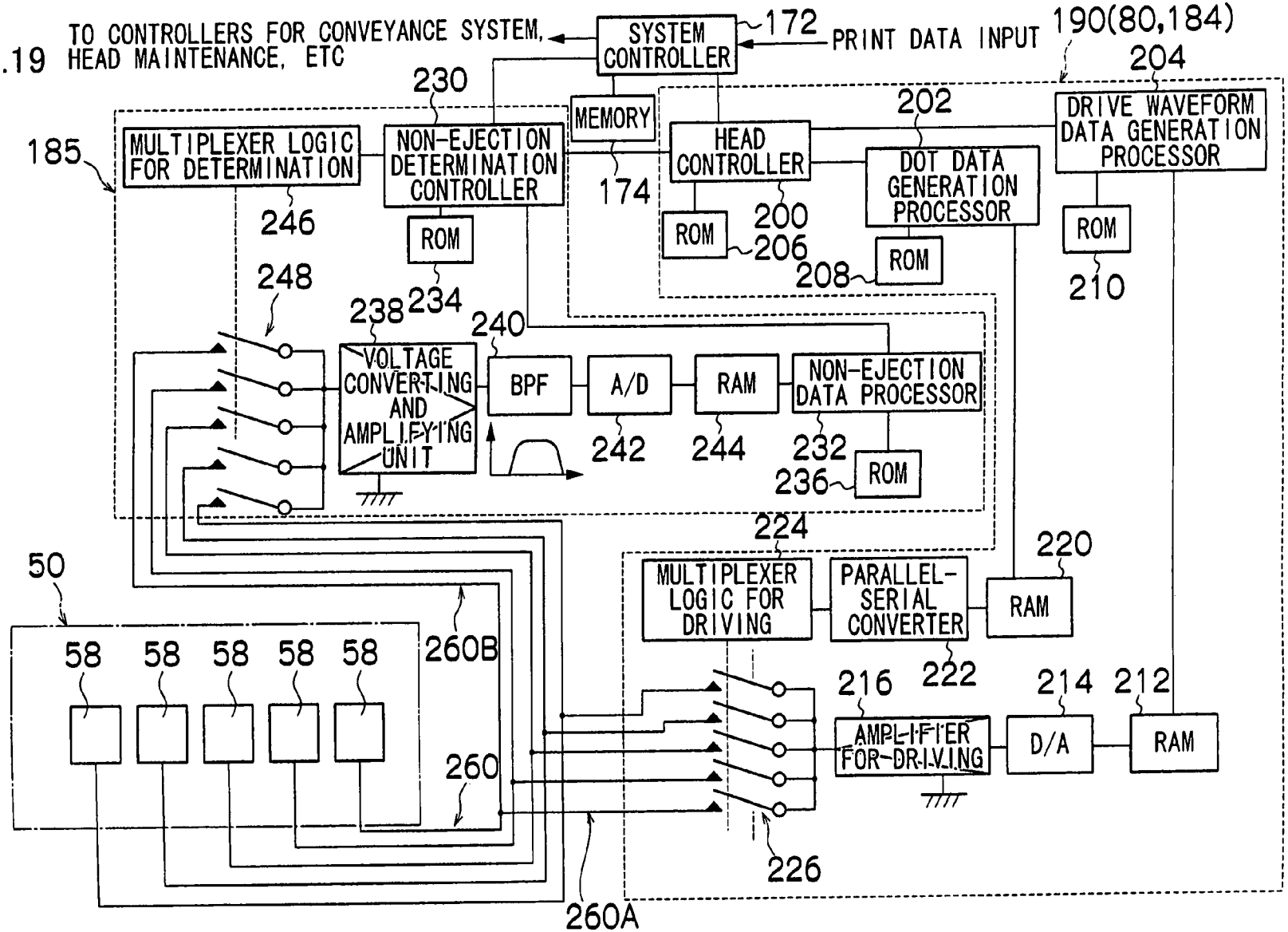
FIG. 19 is a block diagram showing an example of detailed configurations of a print control unit, head drive unit and ejection determination unit shown in FIG. 18.

Furthermore, the piezoelectric elements 58 not only function as driver elements (actuator) for causing the diaphragm 56 to vibrate through the electromechanical transduction effect, but also can function as determining elements (pressure determination sensor) for determining pressure through the mechano-electrical transduction effect. The individual electrode 57 of the piezoelectric element 58 is a driver electrode for applying a drive signal, and at the same time functions as a determination electrode for removing a determination signal. Specifically, application of a drive signal to the piezoelectric element 58 and removal of a determination signal from the same piezoelectric element 58 are performed by the same (common) individual electrode 57. An example of the electrical connection relationship is described in detail hereinafter (FIG. 19).

Of the plurality of piezoelectric elements 58 which can be used as both an actuator for performing ejection drive and a sensor for determining pressure, the piezoelectric elements 58 that are not used in ejection, or a period in which a drive signal for ejection is not applied can be used to obtain the determination signal of ejection pressure from the piezoelectric elements 58.

For example, small amount of the ejection power is enough for ejection when depositing small droplets, thus a small number of piezoelectric elements 58 to be operated is enough. For this reason, piezoelectric elements 58 which are not used for ejection exist, and these elements are used as the sensor for determining the ejection pressure (determining a pressure change). When ejecting small droplets, the pressure to be applied is small, causing a non-ejection phenomena easily, thus the way of utilizing the piezoelectric elements 58 as described is beneficial.

When delaying the drive timings of the plurality of piezoelectric elements 58, the pressure generated by the piezoelectric elements which are driven first is determined by using the piezoelectric elements which are driven afterwards simultaneously. On the other hand, the pressure generated by the piezoelectric elements which are driven afterwards can be determined by using other piezoelectric elements which are driven first simultaneously. Such a method of determination is described using a model shown in FIG. 13.

Figure 13:
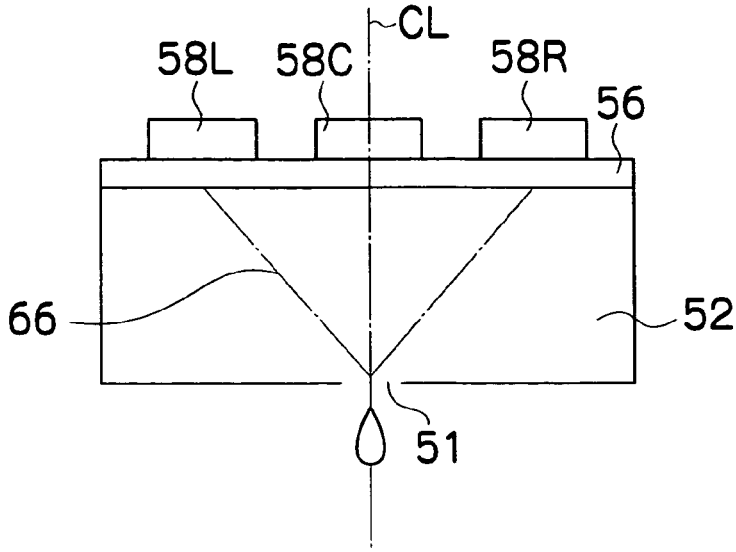
FIG. 13 is a model diagram used to explain a method in which a piezoelectric element which is not driven is used as a pressure determination sensor.

To simplify the explanation, the model is used in which three piezoelectric elements 58C, 58L and 58R are arranged on the diaphragm 56 corresponding to the pressure chamber 52, as shown in FIG. 13.

According to the illustrated model, the central piezoelectric element 58C and the piezoelectric elements 58L and 58R on the sides thereof are arranged with respect to central axis CL of the nozzle 51 to form a symmetrical form. By delaying the drive timings of the left and right (neighboring) piezoelectric elements 58L and 58R and the central piezoelectric element 58C, and ultrasonically vibrating the piezoelectric element 58C, 58L and 58R, the pressure wave is concentrated into the vicinity of the nozzle 51 to perform ejection.

Figure 14A:
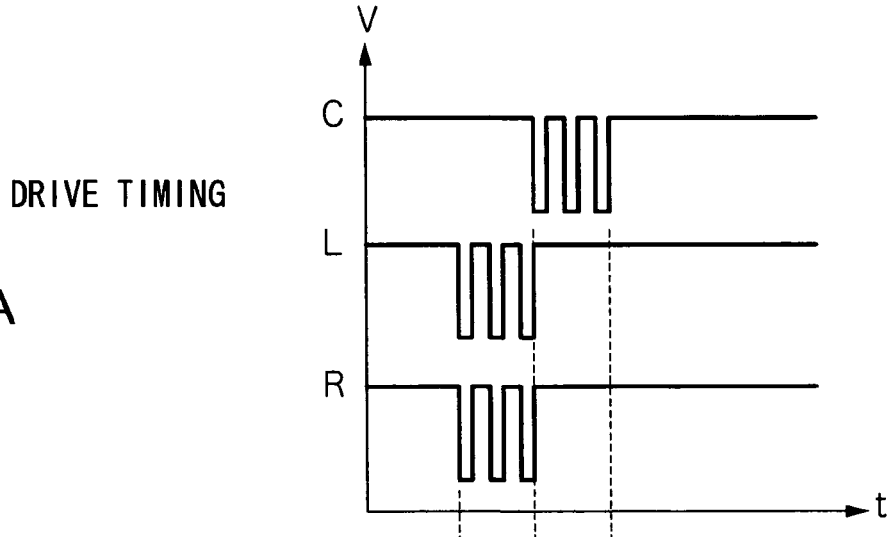
FIG. 14A is a waveform diagram showing the drive timing of each piezoelectric element in the model shown in FIG. 13.

FIG. 14A is a waveform diagram showing the drive timing of each of the piezoelectric elements, and (b) is a waveform diagram showing the pressure determination timing of each of the piezoelectric elements. In each of the figures, horizontal axis indicates the time, and vertical axis indicates voltage of an electrical signal. However, regarding the vertical axis, the signal levels among the elements are offset so that the timing relationship among the signals of the piezoelectric elements can be specified clearly, thus the vertical axis does not show an absolute value of each signal. It should be note that "C", "L" and "R" in FIGS. 14A to 14B indicate the signals corresponding to the piezoelectric elements 58C, 58L and 58R shown in FIG. 13.

As shown in FIG. 14A, of the three piezoelectric elements 58C, 58L and 58R, the left and right (neighboring) piezoelectric elements 58L and 58R are driven first, and the central piezoelectric element 58C is driven belatedly (afterwards).

Figure 14B:
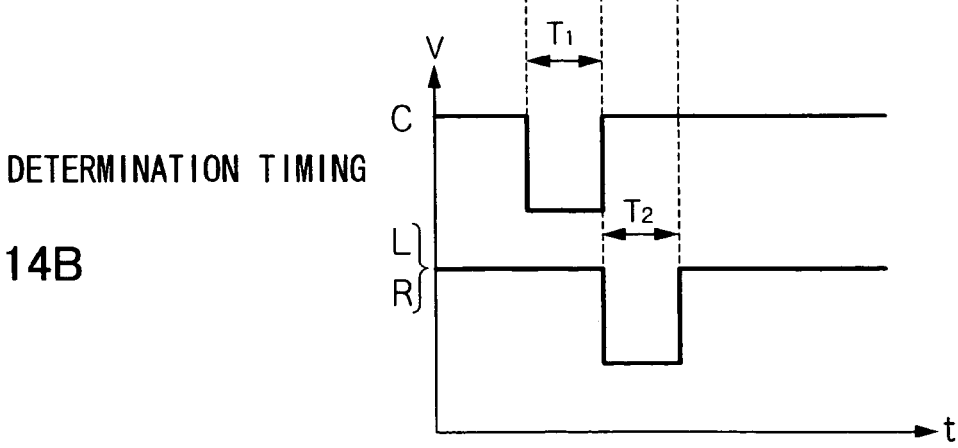
FIG. 14B is a waveform diagram showing the timing of pressure determination by each piezoelectric element.

Moreover, as shown in FIG. 14B, determination of pressure change is performed by the central piezoelectric element 58C during a period T1 when the left and right piezoelectric elements 58L and 58R are driven. Thereafter, when the piezoelectric element 58C is driven, determination of pressure change is performed by the left and right piezoelectric elements 58L and 58R during a drive period T2.

As described above, in this model all of the piezoelectric elements 58C, 58L and 58R are driven for ejection, but by taking advantage of that the drive timings are delayed, determination of pressure can be performed simultaneously during a drive period of non-ejection.

The way of using the plurality of piezoelectric elements 58 disposed in each pressure chamber 52 is not limited to the above-described example. For example, of the plurality of piezoelectric elements 58, by driving piezoelectric elements arranged at the end on the ink supply side so as to cancel the pressure wave generated by other piezoelectric elements and the ultrasonic vibration, the acoustic crosstalk sent to other nozzle and pressure chamber can be reduced.

Figure 15:
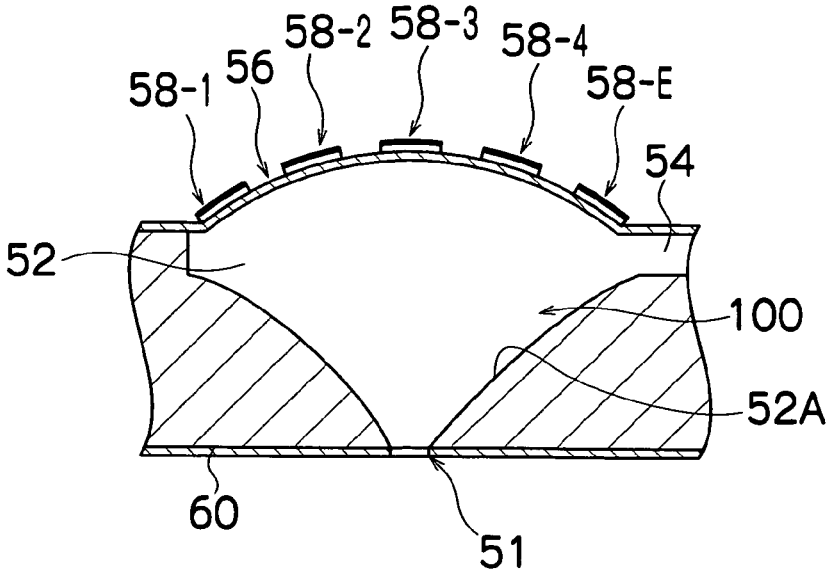
FIG. 15 is a cross sectional view used to explain a drive method of the piezoelectric elements for reducing acoustic crosstalk.

To explain a structure shown in FIG. 15 (the same structure as that of FIG. 8) as an example, supposed that a drive signal applied to a piezoelectric element indicated with reference symbol 58-E in FIG. 15 is a signal of opposite phase with respect to a drive signals of other piezoelectric elements 58-*j* (j=1, 2, 3, 4) such that the pressure wave generated by the piezoelectric elements 58-*j* (j=1, 2, 3, 4) and ultrasonic vibration are canceled, more specifically, a signal of opposite phase in consideration of the difference in the propagation time of vibration caused by the distances among the piezoelectric elements. Drive of the piezoelectric element 58-E does not directly contribute to an ejection operation, but has effects of weakening the pressure wave generated by the piezoelectric elements 58-*j* (j=1, 2, 3, 4). Accordingly, propagation of the pressure wave to the flow passage (flow passage on the ink supply side) on the side upper than the individual supply channel 54 is prevented, and the acoustic crosstalk is reduced.

Of course, in the structures described with reference to FIG. 6 and FIG. 7 as well, by controlling the drive phases of the piezoelectric elements disposed at the end of the ink supply side, the acoustic crosstalk sent to other nozzles and pressure chamber can be reduced.

Figure 16:
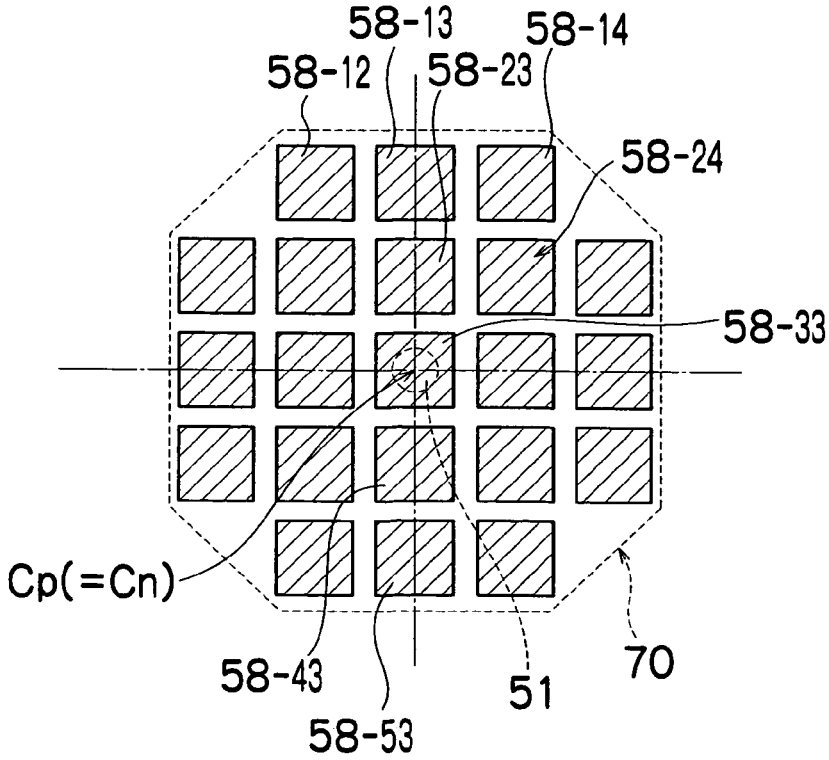
FIG. 16 is a plan view used to explain a method for controlling the ink ejection direction.

By controlling the drive of the plurality of piezoelectric elements 58 which can be driven individually, the ejection direction of the ink can be controlled. A structure shown in FIG. 16 (the same structure as that of FIG. 9C) is now explained as an example. In FIG. 16, the nozzle center Cn and matches with the pressure chamber center Cp, and the piezoelectric elements 58 broken up into squares are arranged so as to create a rotational symmetry of 90 degrees with respect to the axis of symmetry which passes through the nozzle center.

In the pattern of arrangement of the piezoelectric elements in FIG. 16, four corners (upper left, upper right, lower right, and lower left) of a square with a five lines and five rows of piezoelectric elements arranged in a matrix are removed. For convenience in description, positions on the matrix are indicated with a notation (m, n) which combines the line number m and the row number n, and the piezoelectric elements on the positions are expressed as "58-*mn*".

According to this definition, positions of the four corners (1, 5), (1, 5), (5, 1), and (5, 5) in FIG. 16 are not provided with piezoelectric elements, thus piezoelectric elements 58-12,

58-13, and 58-14 are arranged from the left on the first line. Moreover, a piezoelectric element 58-33 is disposed directly above the nozzle 51.

When the ejection direction from the nozzle 51 is oriented in a vertical direction, horizontal direction, or oblique direction in FIG. 16, the piezoelectric elements arranged on the same side with respect to the intended direction with the nozzle center Cn as the base are not driven, or "the piezoelectric elements arranged on the same side" are driven, delaying the drive timings thereof with respect to the drive timing of each piezoelectric element in the case where the ink is ejected toward directly below (vertical direction of the paper) the nozzle 51, or alternatively these elements are driven at the lower frequency as described with reference to FIG. 11.

For example, when ejecting the ink toward the lower direction in FIG. 16, piezoelectric elements 58-43 and 58-53 on the side symmetrically opposite (lower side than the position of the nozzle 51) to the piezoelectric elements 58-23 and 58-13 arranged on the upper side than the position of the nozzle 51, or the drive timing of these elements are delayed, and the elements are driven. In this manner, the ejection direction (spatter direction) of the ink is controlled.

Furthermore, when piezoelectric elements that are not driven exist due to the control of the ejection direction, it is preferred that the non-driven elements be used as the pressure determination sensor to perform determination of ejection pressure. Alternatively, when the drive timings are delayed to drive the piezoelectric elements by means of the control of the ejection direction, it is preferred that ejection pressure be determined during a period of non-ejection, as in the cases described with reference to FIG. 13 and FIGS. 14A to 14B.

By contriving the drive method of the plurality of piezoelectric elements, not only the ejection direction can be controlled as described above, but also, in combination with this, the ejection volume can be controlled. For example, in the example shown in FIG. 16, at the time of ejecting small droplets, the piezoelectric elements 58-*mn* (m=2, 3, 4; n=2, 3, 4) arranged three by three in the vicinity of the center of the pressure chamber area 70 are driven, and the rest of the piezoelectric elements 58-1*k*, 58-5*k*, 58-*k*1, and 58-*k*5 (k=2, 3, 4) arranged circumferentially are used for determining pressure. On the other hand, at the time of ejecting large droplets, all of the piezoelectric elements 58 are driven.

Configuration of Ink Supply System

Figure 17:
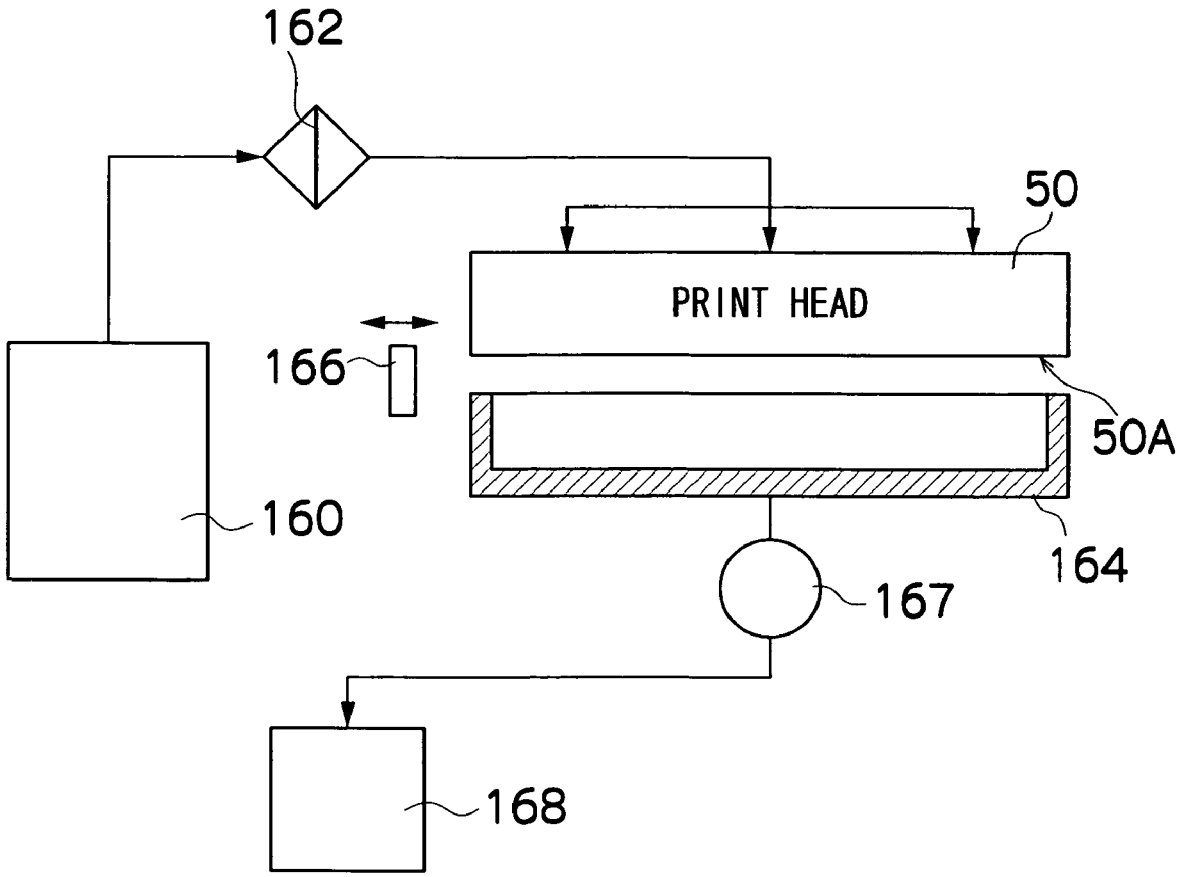
FIG. 17 is a schematic diagram showing a configuration of an ink supply system in the inkjet recording apparatus of this embodiment.

FIG. 17 is a schematic diagram showing a configuration of an ink supply system in the inkjet recording apparatus 10. An ink tank 160 is a base tank that supplies ink to the head 50 and is set in the ink storing and loading unit 14 described with reference to FIG. 1. Specifically, the ink tank 160 shown in FIG. 17 is equivalent to the ink storing and loading unit 14. The aspects of the ink supply tank 160 include a refillable type in which, when the remaining amount of ink is low, the ink supply tank is filled with ink through an unshown filling port, and a cartridge type in which the cartridge is replaced with a new one. In order to change the ink type in accordance with the intended application, the cartridge type is suitable. In this case, it is preferable to identify the ink type information by means of a bar code or the like on the cartridge, and to perform ejection control in accordance with the ink type.

A filter 162 for removing foreign matters and bubbles is disposed between the ink tank 160 and the head 50 as shown in FIG. 17. The filter mesh size in the filter 162 is preferably equivalent to or less than the diameter of the nozzle. Although not shown in FIG. 17, it is preferable to provide a sub-tank integrally to the print head 50 or nearby the head 50. The sub-tank has a damper function for preventing variation in the internal pressure of the head and a function for improving refilling of the print head.

The inkjet recording apparatus 10 is also provided with a cap 164 as a device to prevent the nozzles 51 (not shown in FIG. 17) from drying out or to prevent an increase in the ink viscosity in the vicinity of the nozzles 51, and a cleaning blade 166 as a device to clean the nozzle face 50A. A maintenance unit (a restoring device) including the cap 164 and the cleaning blade 166 can be relatively moved with respect to the head 50 by a movement mechanism (not shown), and is moved from a predetermined holding position to a maintenance position below the head 50 as required.

The cap 164 is displaced up and down relatively with respect to the head 50 by an elevator mechanism (not shown). When the power of the inkjet recording apparatus 10 is turned OFF or when in a print standby state, the cap 164 is raised to a predetermined elevated position so as to come into close contact with the head 50, and the nozzle face 50A is thereby covered with the cap 164.

A cleaning blade 166 is composed of rubber or another elastic member, and can slide on the nozzle face 50A (surface of the nozzle plate) of the head 50 by means of an unshown blade movement mechanism. When ink droplets or foreign matter has adhered to the nozzle plate, the under surface of the nozzle plate is wiped and cleaned by sliding the cleaning blade 166 on the nozzle plate.

During printing or standby, when the frequency of use of specific nozzles is reduced and ink viscosity increases in the vicinity of the nozzles, a preliminary discharge is made to eject the degraded ink toward the cap 164 (also used as an ink receptor).

When a state in which ink is not ejected from the head 50 continues for a certain amount of time or longer, the ink solvent in the vicinity of the nozzles 51 evaporates and ink viscosity increases. In such a state, ink can no longer be ejected from the nozzle 51 even if the piezoelectric element 58 for the ejection driving is operated. Before reaching such a state (in a viscosity range that allows ejection by the operation of the piezoelectric element 58) the piezoelectric element 58 is operated to perform the preliminary discharge to eject the ink of which viscosity has increased in the vicinity of the nozzle toward the ink receptor. After the nozzle surface is cleaned by a wiper such as the cleaning blade 166 provided as the cleaning device for the nozzle face 50A, a preliminary discharge is also carried out in order to prevent the foreign matter from becoming mixed inside the nozzles 51 by the wiper sliding operation. The preliminary discharge is also referred to as "dummy discharge", "purge", "liquid discharge", and so on.

Further, when bubbles are immixed in the nozzle 51 or the pressure chamber 52, or when the ink viscosity inside the nozzle 51 exceeds a certain level, ink can no longer be ejected by the preliminary ejection. In such a case, a cap 64 as a suctioning device to remove the ink inside the pressure chamber 52 by suction with a suction pump 167, or the like, is placed on the nozzle face 50A of the head 50, and the ink (the ink in which bubbles are immixed or the ink of which viscosity increases) is drawn. The ink which is removed by suction by this suction action is sent to a recovery tank 168. The ink collected in the recovery tank 168 may be reused, or discarded if it cannot be reused.

The abovementioned suction action is performed with respect to all the ink in the pressure chamber 52, so that the amount of ink consumption is considerable. Therefore, it is preferred that a preliminary ejection is performed when the increase in the viscosity of the ink is small. That this suction action is performed at the time of initial loading of ink onto the head 50, or at the time of starting to use after long hours of stop.

Description of Control System

Figure 18:
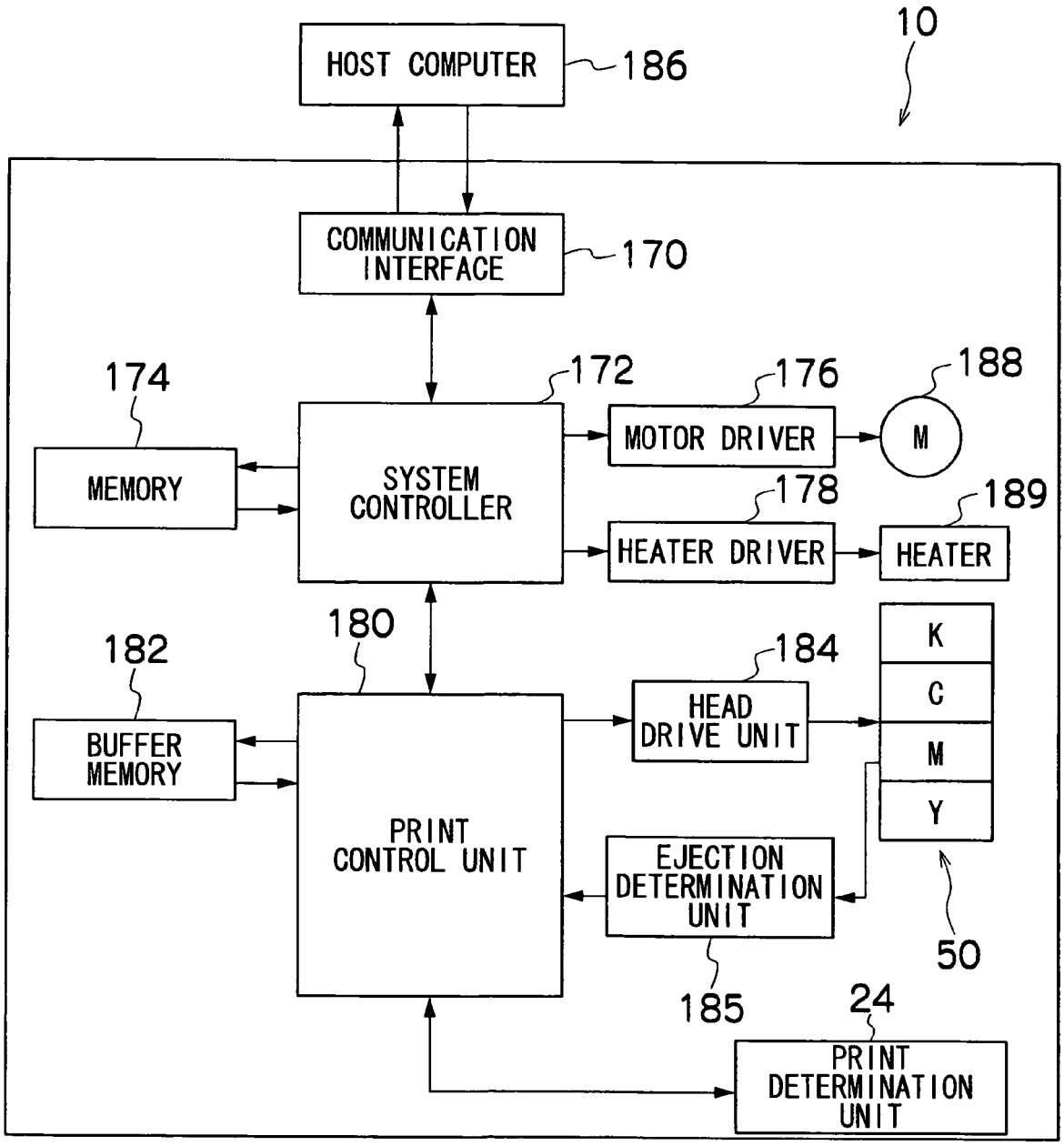
FIG. 18 is a is a block diagram showing a substantial part of the system configuration of the inkjet recording apparatus of this embodiment.

FIG. 18 is a block diagram showing a substantial part of the system configuration of the inkjet recording apparatus 10. The inkjet recording apparatus 10 comprises a communication interface 170, system controller 172, memory 174, motor driver 176, heat driver 178, print control unit 180, buffer memory 182, head drive unit 184, ejection determination unit 185, and other components.

The communication interface 170 is an interface unit for receiving image data sent from a host computer 186. A serial interface such as USB, IEEE1394, Ethernet, wireless network, or a parallel interface such as a Centronics interface may be used as the communication interface 170. A buffer memory (not shown) may be mounted in this portion in order to increase the communication speed.

When image data sent out from the host computer 186 is received by the inkjet recording apparatus 10 through the communication interface 170, and is temporarily stored in the memory 174.

The memory 174 is a storage device which temporarily stores images inputted through the communication interface 170, and data is written and read through the system controller 172. The memory 174 may be a storage device which cannot read or write data, or a storage device such as EEPROM which can read and write data. Further, the memory 174 is not limited to memory composed of a semiconductor element, and a hard disk drive or another magnetic medium may be used.

The system controller 172 is constituted by a central processing unit (CPU) and peripheral circuits thereof, and the like, and it functions as a control device for controlling the whole of the inkjet recording apparatus 10 in accordance with a prescribed program, as well as a calculation device for performing various calculations. More specifically, the system controller 172 controls the various sections, such as the communication interface 170, memory 174, motor driver 176, heater driver 178, and the like, as well as controlling communications with the host computer 186 and writing and reading to and from the memory 174, and it also generates control signals for controlling the motor 188 and heater 189 of the conveyance system.

The memory 174 is stored with a program executed by the CPU of the system controller 172 and various data required for control. The memory 174 may be used as a region for temporarily storing image data, and also as a development region of the program and a computation region of the CPU.

The motor driver (drive circuit) 176 drives the motor 188 in accordance with commands from the system controller 172. The heater driver (drive circuit) 178 drives the heater 189 of the post-drying unit 42 (see FIG. 1) or the like in accordance with commands from the system controller 172.

The print controller 180 has a signal processing function for performing various tasks, compensations, and other types of processing for generating print control signals from the image data stored in the memory 174 in accordance with commands from the system controller 172 so as to supply the generated print data (dot data) to the head drive unit 184. Prescribed signal processing is carried out in the print controller 180, and the ejection amount and the ejection timing of the ink droplets from the respective print heads 50 are controlled via the head drive unit 184, on the basis of the print data. By this means, prescribed dot size and dot positions can be achieved.

The print controller 180 is provided with the buffer memory 182; and image data, parameters, and other data are temporarily stored in the buffer memory 182 when image data is processed in the print controller 180. The aspect shown in FIG. 18 is one in which the buffer memory 182 accompanies the print controller 180; however, the memory 174 may also serve as the buffer memory 182. Also possible is an aspect in which the print controller 180 and the system controller 172 are integrated to form a single processor.

The image data to be printed is externally inputted through the communication interface 170, and is stored in the memory 174. In this stage, for example, the RGB image data is stored in the memory 174.

The image data stored in the memory 174 is sent to the print control unit 180 through the system controller 172, and is converted to dot data for each ink color in the print control unit 180 by means of a dither method or a halftone technology such as an error diffusion method. In the inkjet recording apparatus 10 forms a pseudo continuous tone image by changing the density of minuscule droplet dots or dot size formed by the ink (color material). Therefore, it is necessary to change to a dot pattern so as to recreate a tone (shading in the image) of an input digital image as faithful as possible.

Specifically, the print control unit 180 performs processing of converting input RGB image data to dot data of four colors of K, C, M, and Y. Accordingly, the dot data (for the processing liquid and each color) generated by the print control unit 180 is stored in the buffer memory 182.

The head drive unit 184 generates a drive control signal of the head 50 of each color on the basis of print data (i.e. the dot data stored in the buffer memory 182) supplied from the print control unit 180. The piezoelectric elements 58 of the head 50 are driven by means of the drive control signal supplied from the head drive unit 184, whereby the ink is ejected from the nozzle 51. A feedback control system for keeping the drive conditions for the heads constant may be included in the head drive unit 184.

By controlling the ejection of the ink from the head 50 in synchronization with the conveyance speed of the recording paper 16 which is a recording medium, an image is formed on the recording paper 16.

The ejection determination unit 185 is a signal processing unit for subjecting a determination signal in accordance with the change of pressure in the pressure chamber 52, the change being determined by the piezoelectric elements 58, to a predetermined signal processing. "Determination signal" is a signal which is obtained from the piezoelectric elements 58 when the piezoelectric elements 58 function as the pressure sensor for determining the pressure of the pressure chamber 52, and is a determination signal corresponding to the change of the ink pressure when ejection drive or abnormal ejection determination drive is executed by other piezoelectric elements 58 at the time of ink ejection. To be concrete, the determination signal is a signal corresponding to a value of ink pressure (variation), or to a resonant condition (resonance frequency) and a response determined based on the characteristics of the nozzle 51, pressure chamber 52, individual supply channel 54, common flow passage 55, piezoelectric element 58, ink and the like with respect to the drive signal (impedance change).

The determination signal subjected to the signal processing by the ejection determination unit 185 is sent to the system controller 172 through the print control unit 180, and the presence or absence of a trouble in the nozzle 51 in the pressure chamber 52 or an abnormal ejection caused by generation of bubbles inside the pressure chamber 52 is determined.

The print determination unit 24 is a block including an image sensor as described with reference to FIG. 1, which reads in the image printed onto the recording paper 16 to determine a print status (presence/absence of ejection, variation in droplet deposition, optical concentration, etc.), and supplies the determination results to the print control unit 180.

According to requirements, the print controller 180 makes various corrections with respect to the head 50 on the basis of information obtained from the print determination unit 24. Furthermore, the system controller 172 implements control for carrying out preliminary ejection, suctioning, and other prescribed restoring processes on the head 50, on the basis of the information obtained from the print determination unit 24 and the ejection determination unit 185.

Drive Control and Pressure Determination Control of Piezoelectric Element

Next, drive control of the piezoelectric element 58 and pressure determination (abnormal ejection determination) control when using the piezoelectric element 58 as the determination sensor are described in detail.

FIG. 19 is a block diagram showing an example of detailed configurations of the print control unit 180, head drive unit 184 and ejection determination unit 185 described with reference to FIG. 18. The same reference symbols are used to indicate the portions corresponding to those in the configuration of FIG. 18. The area surrounded by a dotted line and indicated with reference symbol 190 corresponds to a configuration of a combination of the print control unit 180 and the head drive unit 184 described with reference to FIG. 18 (this area is called "ejection drive unit 190" inclusively). To simplify the illustration of FIG. 19, five piezoelectric elements 58 are illustrated within the head 50, but various patterns are possible regarding the number of piezoelectric elements and the arrangement pattern thereof, as described in FIG. 6 through FIGS. 10A to 10C.

The ejection drive unit 190 in FIG. 19 is constituted by a head controller 200, dot data generation processor 202, drive waveform data generation processor 204, ROM 206, 208, 210 as storage devices provided in the above components, RAM 212 for temporarily storing a drive wave form generated by the drive waveform data generation processor 204, D/A converter 214, amplifier for driving 216, RAM 220 as a temporal storage region for dot data generated by the dot data generation processor 202, parallel-serial converter 222, multiplexer logic for driving 224, switch circuit 226, and other components.

Further, the ejection determination unit 185 is constituted by a non-ejection determination controller 230, non-ejection data processor 232, ROM 234, 236 as storage devices provided in the above components, voltage converting and amplifying unit 238, bandpass filter (BPF) 240, A/D converter 242, RAM 244 as a temporal storage region for a determination signal subjected to the signal processing, multiplexer logic for determination 246, switch circuit 248, and other components.

The processors, controllers and the like shown in FIG. 19 may be aggregated to form one or more devices by means of a one-chip microcomputer or MPU. Further, the memory such as ROM, RAM, and the like may be configured such that the region inside a single device is divided.

The system controller 172 receives print data of characters, image or the like from the exterior, and controls the head controller 200 and non-ejection determination controller 230, or a conveyance controller for controlling conveyance of the recording paper 16 (not shown in FIG. 19), a head maintenance controller for controlling the recovery processing when an abnormal ejection is present in the head 50, or the like, to control the print processing.

The head controller 200 instructs the dot data generation processor 202 to generate dot data for printing on the basis of an instruction and data from the system controller 172, and instructs the drive waveform data generation processor 204 to generate a drive waveform for ink ejection.

Moreover, the head controller 200 transmits information of the piezoelectric elements 58 to be subjected to an abnormal ejection determination operation, which is notified from the dot data generation processor 202, and further instructs the dot data generation processor 202 to change the generated dot on the basis of the information on an abnormal ejection sent from the non-ejection determination controller 230.

The drive waveform data generation processor 204 generates a piezoelectric element drive waveform for generating dots of the respective sizes, performing a maintenance action (preliminary ejection), and preventing the ink form being vaporized on the nozzle face 50A, in accordance with the instruction of the head controller 200, temperature/humidity conditions, medium conditions, and the like.

The drive waveform data is stored in the RAM 212, and subjected to D/A conversion by means of the D/A converter 214, with conforming it to a predetermined clock signal, amplified to a predetermined voltage by the amplifier for driving 216, switched by the switch circuit 226, and supplied to the piezoelectric element 58 to be driven.

The dot data generation processor 202 generates arrangement information of dots from the information of characters or images in accordance with the instruction from the head controller 100. The generated dot data is stored in the RAM 220. The dot data stored in the RAM 220 is subjected to parallel-serial conversion by the parallel-serial converter 222, and sent to the vicinity of the piezoelectric element 58 by a signal line having relatively small amount of data. The data output from the parallel-serial converter 222 is input to the multiplexer logic for driving 224, conformed to a predetermined clock signal, synchronized with the abovementioned drive waveform data, the switch circuit 226 is switched by the multiplexer logic for driving 224, and the drive wave form is sent to the piezoelectric element 58 to be driven.

Furthermore, the dot data generation processor 202 determines the piezoelectric elements 58 to be subjected to the abnormal ejection determination operation on the basis of the information on dot arrangement (operational status of the piezoelectric elements 58 in the pressure chamber 52), and notifies the head controller 200 of it.

As described with reference to FIG. 6 through FIGS. 10A to 10C, each piezoelectric element 58 has the individual electrode 57, a drive signal is applied through the individual electrode 57 at the time of drive, and the determination signal is removed at the time of determination during a non-drive state. Specifically, the individual electrode 57 of the piezoelectric element 58 is connected to the head drive unit 184 and the ejection determination unit 185 via a common signal line 260, as shown in FIG. 19.

Drive signal lines 260A diverging from the common signal line 260 connected to the individual electrode 57 of the piezoelectric element 58 are connected to the switch circuit 226 of the ejection drive unit 190, and by switching the connection of the switch circuit 226 by means of the multiplexer logic for driving 224, application of the drive signal to each of the piezoelectric elements 58 is controlled.

Moreover, determination signal lines 260B diverging from the common signal line 260 are connected to the switch circuit 248 of the ejection determination unit 185, and by switching the connection of the switch circuit 248 by means of the multiplexer logic for determination 246, removal of the determination signal from each of the piezoelectric elements 58 is controlled. Although not shown, an aspect is considered in which a flexible substrate is used as the wiring disposed from the head 50 to the control system. In the flexible substrate, wiring made of copper or the like is provided on a polyimide resin sheet or the like, and the wiring may be formed on either one of the surface or the back of the resin sheet, or on both faces.

The non-ejection determination controller 230 in the ejection determination unit 185 acquires the determination signal from the piezoelectric element 58 on the basis of an instruction from the system controller 172 and the information of the piezoelectric element 58 subjected to the abnormal ejection determination operation, the information being sent from the head controller 200, and performs the abnormal ejection determination operation. When an abnormal ejection is detected, the head controller 200 is notified of it.

The determination signals obtained in this manner are subjected to voltage conversion/amplification sequentially by the voltage converting and amplifying unit 238, with switching the switch circuit 248 by the multiplexer logic for determination 246 controlled by the non-ejection determination controller 230. Thereafter, noise components with low frequencies are eliminated by the bandpass filter 240, whereby unnecessary components with high frequencies conforming to the sampling frequencies of the A/D converter are eliminated. Moreover, after the A/D conversion by means of the A/D converter 242, the determinations signals are stored in the memory (RAM) 244.

The non-ejection data processor 232 processes the data stored in the memory 244, and judges whether or not the nozzle is in the state of an abnormal ejection. As a result, when the nozzle 51 in the state of causing an abnormal ejection is found, the result is transmitted to the non-ejection determination controller 230.

The determination of an abnormal ejection as described in the present embodiment can be executed when ejecting ink droplets to perform image formation, but can be executed by driving the piezoelectric element 58 using an abnormal ejection determination waveform so that the ink is not ejected.

In this case, the dot data generation processor 202 determines the piezoelectric elements 58 to be subjected to the abnormal ejection determination operation on the basis of the information on dot arrangement (operational status of the piezoelectric elements 58 in the pressure chamber 52), and notifies the head controller 200 of it. In response to this notification, the head controller 200 instructs the dot data generation processor 202 to generate dot data including "dots which are not ejected" corresponding to the abnormal ejection determination waveform.

"Abnormal ejection determination waveform" here means a waveform for driving the piezoelectric elements 58 in the pressure chamber 52 such that the ink is not ejected from the nozzle 51 for abnormal ejection determination at the time when the normal ink ejection is not performed. The abnormal ejection determination waveform determines the ink pressure in other (non-driven) piezoelectric elements at the abovementioned time to perform abnormal ejection determination. Therefore, the abnormal ejection determination waveform does not cause an ink ejection operation, and is suitable for abnormal ejection determination. It is preferred that the abnormal ejection determination waveform be a waveform which is different from the drive waveform at the time of ink ejection, and an example of such a waveform is illustrated preferably so as to form a sinusoidal waveform at the frequency in which the wave form resonates with respect to the size of a bubble which highly likely to affect ejection and be immixed in the pressure chamber 52. Alternatively, as the abnormal ejection determination waveform, a waveform in the form of a step or an impulse may be added to check the response of the whole pressure chambers 52.

The above explanation illustrates the inkjet recording apparatus as an example of an image forming apparatus, but the applicable scope of the present invention is not limited to this. For example, the liquid ejection apparatus of the present invention can be applied to a photographic image formation apparatus and the like which applies a developer onto a printing paper without having a contact therewith. Further, the applicable scope of the liquid ejection apparatus of the present invention is not limited to the image forming apparatus, thus the present invention can be applied to various apparatuses (e.g. liquid application apparatus, coating apparatus and the like) in which a liquid ejection head is used to eject processing liquid and other various liquids toward an ejection receiving medium.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection head, comprising:

a plurality of liquid ejection ports;

a plurality of pressure chambers which are respectively communicated with the liquid ejection ports;

a diaphragm which configures at least one surface of each of the pressure chambers; and a plurality of piezoelectric elements which are disposed on a surface of the diaphragm opposite from the pressure chamber, and from which at least individual electrodes are separated in an area corresponding to the pressure chamber, wherein:

each of the pressure chambers has an inclined inner wall forming substantially a funnel shape such that a cross sectional area becomes smaller toward the liquid ejection port; and liquid is ejected from the liquid ejection port by causing the plurality of piezoelectric elements to make vibration.

2. The liquid ejection head as defined in claim 1, wherein the vibration is ultrasonic vibration.

3. A liquid ejection head, comprising:

a plurality of liquid ejection ports;

a plurality of pressure chambers which are respectively communicated with the liquid ejection ports;

a diaphragm which configures at least one surface of each of the pressure chambers; and a plurality of piezoelectric elements which are disposed on a surface of the diaphragm opposite from the pressure chamber, and from which at least individual electrodes are separated in an area corresponding to the pressure chamber, wherein liquid is ejected from the liquid ejection port by causing the plurality of piezoelectric elements to make vibration, wherein the vibration is ultrasonic vibration, and wherein a thickness of a piezoelectric substance of the piezoelectric element is one-fourth or one-half of a sonic wavelength in the piezoelectric substance of a drive frequency of the ultrasonic vibration.

4. The liquid ejection head as defined in claim 1, wherein the plurality of piezoelectric elements are arranged concentrically in the area of the diaphragm corresponding to the pressure chamber.

5. The liquid ejection head as defined in claim 1, wherein the plurality of piezoelectric elements are arranged in a matrix along a first direction and a second direction perpendicular to the first direction in the area of the diaphragm corresponding to the pressure chamber.

6. The liquid ejection head as defined in claim 1, wherein a form of array of the plurality of piezoelectric elements in the area of the diaphragm corresponding to the pressure chamber has rotational symmetries through a degrees ($0° < \alpha < 180°$).

7. The liquid ejection head as defined in claim 1, wherein, when viewed from a direction perpendicular to an ejection face on which the plurality of liquid ejection ports are formed, a center of a group of the piezoelectric elements formed by arraying the plurality of piezoelectric elements substantially matches with a center of the liquid ejection port corresponding to the pressure chamber for which the group of piezoelectric elements is disposed.

8. The liquid ejection head as defined in claim 1, wherein, when viewed from a direction perpendicular to an ejection face on which the plurality of liquid ejection ports are formed, a center of a group of the piezoelectric elements formed by arraying the plurality of piezoelectric elements is displaced in a direction of relative movement of the liquid ejection head and an ejection receiving medium, with respect to a center of the liquid ejection port corresponding to the pressure chamber for which the group of piezoelectric elements is disposed.

9. The liquid ejection head as defined in claim 1, wherein in the area of the diaphragm corresponding to the pressure chamber, a piezoelectric element having a larger area is arranged in an area on a downstream side in a relative movement direction of an ejection receiving medium with respect to the liquid ejection head.

10. The liquid ejection head as defined in claim 1, wherein in the area of the diaphragm corresponding to the pressure chamber, a larger number of piezoelectric elements are arranged in an area on a downstream side in a relative movement direction of an ejection receiving medium with respect to the liquid ejection head.

11. The liquid ejection head as defined in claim 1, wherein the diaphragm has a convex surface on a side opposite to the pressure chamber.

12. A liquid ejection apparatus, comprising:

the liquid ejection head as defined in claim 1;

a drive signal generating device which generates drive signals for driving the plurality of piezoelectric elements;

a drive control device which controls the drive signals applied to the piezoelectric elements; and a conveying device which conveys at least one of the liquid ejection head and an ejection receiving medium so as to relatively move the ejection receiving medium with respect to the liquid ejection head.

13. The liquid ejection apparatus as defined in claim 12, wherein the drive control device controls variably at least one of a frequency of the drive signal and an application timing of the drive signal with respect to each of the piezoelectric elements.

14. The liquid ejection apparatus as defined in claim 12, wherein liquid droplets are ejected from the liquid ejection ports towards an upstream side of a direction of relative movement of the ejection receiving medium with respect to the liquid ejection head.

15. The liquid ejection apparatus as defined in claim 12, wherein:

the drive signal generating device generates a first drive signal for ultrasonically vibrate the piezoelectric elements, and a second drive signal having a lower frequency than that of the first drive signal; and the drive control device controls selective application of the first drive signal and the second drive signal to the piezoelectric elements.

16. The liquid ejection apparatus as defined in claim 12, wherein at least one of the plurality of piezoelectric elements is also used as a determining element for determining pressure during drive of another of the piezoelectric elements, and the liquid ejection apparatus further comprises:

a determination signal processing device which performs processing on a determination signal obtained from the piezoelectric element that is used as the determining element; and a judging device which judges a state of ejection according to a result of processing carried out by the determination signal processing device.

17. The liquid ejection apparatus as defined in claim 12, wherein, of the plurality of piezoelectric elements, a piezoelectric element disposed in a vicinity of a liquid supply port of the pressure chamber is applied with a drive signal which causes the piezoelectric element to generate a pressure wave having a phase for relatively weakening a pressure wave generated by another of the piezoelectric elements.

18. An image forming apparatus, comprising the liquid ejection apparatus as defined in claim 12 and forming an image on the ejection receiving medium by means of the liquid ejected from the liquid ejection head.

19. A liquid ejection head, comprising:

a liquid ejection port;

a pressure chamber which communicates with the liquid ejection port; and a plurality of piezoelectric elements corresponding to the pressure chamber, wherein:

the pressure chamber has an inclined inner wall forming substantially a funnel shape such that a cross sectional area becomes smaller toward the liquid ejection port; and liquid is ejected from the liquid ejection port by causing the plurality of piezoelectric elements to pressurize the pressure chamber.

20. The liquid ejection head as defined in claim 19, wherein each piezoelectric element of the plurality of piezoelectric elements includes a separate piezoelectric substances.

21. The liquid ejection head as defined in claim 19, wherein each piezoelectric element of the plurality of piezoelectric elements includes a separate individual electrode.

22. The liquid ejection head as defined in claim 2, wherein the plurality of piezoelectric elements generate pressure waves having a frequency of the ultrasonic vibration, the generated pressure waves being propagated toward the liquid ejection port associated with the plurality of piezoelectric elements to eject a mist of the liquid from the liquid ejection port.

23. The liquid ejection head as defined in claim 1, wherein the inclined inner wall of each of the pressure chambers is curve shaped.

24. The liquid ejection head as defined in claim 23, wherein the curve shaped inner wall of each of the pressure chambers is exponentially curve shaped.

25. The liquid ejection head as defined in claim 19, wherein the inclined inner wall of the pressure chambers is curve shaped.

26. The liquid ejection head as defined in claim 25, wherein the curve shaped inner wall of the pressure chamber is exponentially curve shaped.

* * * * *